US008616545B2

(12) United States Patent
Takiguchi

(10) Patent No.: US 8,616,545 B2
(45) Date of Patent: Dec. 31, 2013

(54) SHEET FEEDING APPARATUS AND IMAGE FORMING APPARATUS

(75) Inventor: Masatoshi Takiguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/406,995

(22) Filed: Feb. 28, 2012

(65) Prior Publication Data

US 2012/0235347 A1 Sep. 20, 2012

(30) Foreign Application Priority Data

Mar. 16, 2011 (JP) ..... 2011-058348
Nov. 15, 2011 (JP) ..... 2011-249811

(51) Int. Cl.
*B65H 3/06* (2006.01)

(52) U.S. Cl.
USPC ..... 271/118; 271/126

(58) Field of Classification Search
USPC ..... 271/113, 114, 115, 117, 118, 126, 127
See application file for complete search history.

(56) References Cited

U.S. PATENT DOCUMENTS

| | | | | |
|---|---|---|---|---|
| 5,711,519 | A * | 1/1998 | Bortolotti | 271/116 |
| 5,713,568 | A * | 2/1998 | Tamehira | 271/117 |
| 5,725,208 | A * | 3/1998 | Miyauchi | 271/10.09 |
| 5,738,348 | A * | 4/1998 | Yasue et al. | 271/118 |
| 6,089,562 | A * | 7/2000 | Jang et al. | 271/10.11 |
| 6,257,569 | B1 * | 7/2001 | Rhodes et al. | 271/117 |
| 6,824,133 | B2 * | 11/2004 | Richtsmeier | 271/153 |
| 7,270,323 | B2 * | 9/2007 | Somemiya | 271/127 |
| 7,510,180 | B2 * | 3/2009 | Jang et al. | 271/127 |
| 2008/0101837 | A1 | 5/2008 | Cho | |
| 2011/0156336 | A1 | 6/2011 | Agata et al. | |
| 2011/0316222 | A1 | 12/2011 | Takiguchi et al. | |
| 2011/0316223 | A1 | 12/2011 | Takiguchi et al. | |

FOREIGN PATENT DOCUMENTS

| | | | |
|---|---|---|---|
| DE | 19548910 | A1 | 6/1996 |
| EP | 1918230 | A2 | 5/2008 |
| JP | 2006-044868 | A | 2/2006 |
| JP | 2008-15077 | | 1/2008 |
| JP | 2008-105790 | | 5/2008 |

OTHER PUBLICATIONS

European Search Report issued on Jun. 6, 2013 by the European Patent Office in European Patent Application No. 12158528.5.

* cited by examiner

*Primary Examiner* — Kaitlin Joerger
(74) *Attorney, Agent, or Firm* — Fitzpatrick, Cella, Harper & Scinto

(57) ABSTRACT

A link member is rotatably supported by a lifting plate. When the lifting plate moves upward and downward, the movement of the link member is guided by a guide portion provided on a link guide hole. Before sheet feeding starts, the movement of the link member is regulated by a holding portion provided on a lower end of the guide portion so as to hold the lifting plate in a standby position against a biasing force of a feed spring. When the sheet is fed, a feed cam rotating integrally with a feed roller presses the link member to release the link member from being locked by the holding portion of the link guide hole to thereby make the link member movable along the guide portion.

24 Claims, 28 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and more particularly to an arrangement for lifting a sheet supporting member having sheets stacked thereon so as to press the sheets against a feed roller.

2. Description of the Related Art

Today, among image forming apparatuses such as a copy machine, a printer, a facsimile machine and the like, widely used types of image forming apparatus feed a sheet from a sheet feeding apparatus to an image forming portion to form an image. Here, the sheet feeding apparatus generally has a sheet cassette serving as a sheet storage portion and being attachable to and detachable from the body of the apparatus, and automatically feeds a sheet stored in the sheet cassette to the image forming portion.

For example, there is known sheet cassette arranged to be able to lift and lower a sheet supporting member which has sheets stacked thereon and when the sheets are fed, is lifted to press the stacked sheets against a feed roller. When the sheets are fed, the feed roller rotates to feed the sheets pressed by the sheet supporting member to the image forming portion, one by one from the uppermost sheet.

Such a sheet feeding apparatus has a cam provided coaxially with the feed roller so as to lift and lower the sheet supporting member. When the apparatus is in a standby state and is not feeding a sheet, the sheet supporting member is forced down to a certain position by the cam, whereby the sheets are easily set and replaced. In the course of feeding out the sheets, the cam presses down the sheet supporting member, whereby a feed force by the feed roller is not applied to the sheets to be fed out. This can improve sheet separability in a separation unit such as a separation pad.

The sheet feeding apparatus of such a configuration requires one vertical reciprocating motion of the sheet supporting member for each rotation of a drive shaft, which imposes a problem in that it is difficult to reduce the size (outermost diameter) of the cam. For example, in a case in which the sheet supporting member is provided rotatably in a vertical direction, a reduction in size of the cam reduces a rotational angle of the sheet supporting member, thereby reducing the spacing between the feed roller and the sheet supporting member.

Such a reduction in the spacing between the feed roller and the sheet supporting member reduces the number of sheets to be stacked on the sheet supporting member. Then, the user has to frequently replenish sheets, thereby causing a problem of poor operability. Since there is a trade-off between the size of the cam and the rotational angle of the sheet supporting member, it is difficult to reduce the size of the cam.

As the conventional sheet feeding apparatus for the purpose of reduction in size of the cam and noise thereof, there has been proposed an arrangement of providing a lever member serving as a link member between the cam and the sheet supporting member for performing rotation. According to Japanese Patent Application Laid-Open No. 2008-105790, first and second arm portions are disposed in a lever member disposed in the apparatus body, wherein the first arm portion is in sliding contact with a cam fixed to a drive shaft of a feed roller and the second arm portion is in sliding contact with the front end portion of the sheet supporting member. According to U.S. Patent Publication No. 2008/0101837 as another arrangement, an end portion of the lever member rotatably provided in the apparatus body is locked to the sheet supporting member and an intermediate portion of the lever member is in sliding contact with the cam fixed to the drive shaft of the feed roller.

Such conventional sheet feeding apparatuses can reduce the size of the cam, but has a problem in that it is difficult to reduce the entire size of the sheet feeding apparatus under the constraints of fulcrum placement of a lever member abutting against the cam and serving as a link member so as to transmit a force to the sheet supporting member. For example, the arrangement disclosed in Japanese Patent Application Laid-Open No. 2008-105790 is such that the second arm portion of the lever member is in sliding contact with the front end of the sheet supporting member so as to move the sheet supporting member against a biasing force of a feed spring. Thus, the second arm portion has a smooth relatively long arcuate shape. In a case in which the second arm portion has such a shape, the second arm portion swings on the underside of the separation unit, whereby it is necessary to provide a space for the second arm portion to swing. Thus, the above arrangement can reduce the outermost diameter of the cam, but may increase the entire size of the sheet feeding apparatus.

The arrangement disclosed in U.S. Patent Publication No. 2008/0101837 requires an end portion of the lever member to be locked to the sheet supporting member and an intermediate portion thereof to be in sliding contact with the cam. This arrangement imposes constraints on the place where the turning fulcrum of the lever member can be positioned between the rotational trajectory of the cam and the rotational trajectory of the sheet supporting member. Further, the turning fulcrum of the lever member is projected toward a downstream side surface of the feed roller, whereby this arrangement can reduce the outermost diameter of the cam, but may increase the entire size of the sheet feeding apparatus. An increase in the entire size of sheet feeding apparatus increases the entire size of the image forming apparatus housing the sheet feeding apparatus, whereby this arrangement imposes a problem of enlarging the installation place of the image forming apparatus.

SUMMARY OF THE INVENTION

In view of the present circumstances described above, it is an object of the present invention to provide a sheet feeding apparatus and an image forming apparatus capable of preventing an increase in the entire size of the apparatus even in a case of using a link member.

A sheet feeding apparatus of the present invention includes: a sheet supporting member capable of being lifted and lowered while supporting a sheet; a feed roller located above the sheet supporting member and feeding the sheet stacked on the sheet supporting member; and a lifting portion lifting and lowering the sheet supporting member, the lifting portion including a biasing portion which biases the sheet supporting member toward the feed roller; a link member which is rotatably supported by the sheet supporting member; and a regulation release member which rotates integrally with the feed roller and enables movement of the link member being restricted from movement when the sheet is fed.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings.

Figure 1:
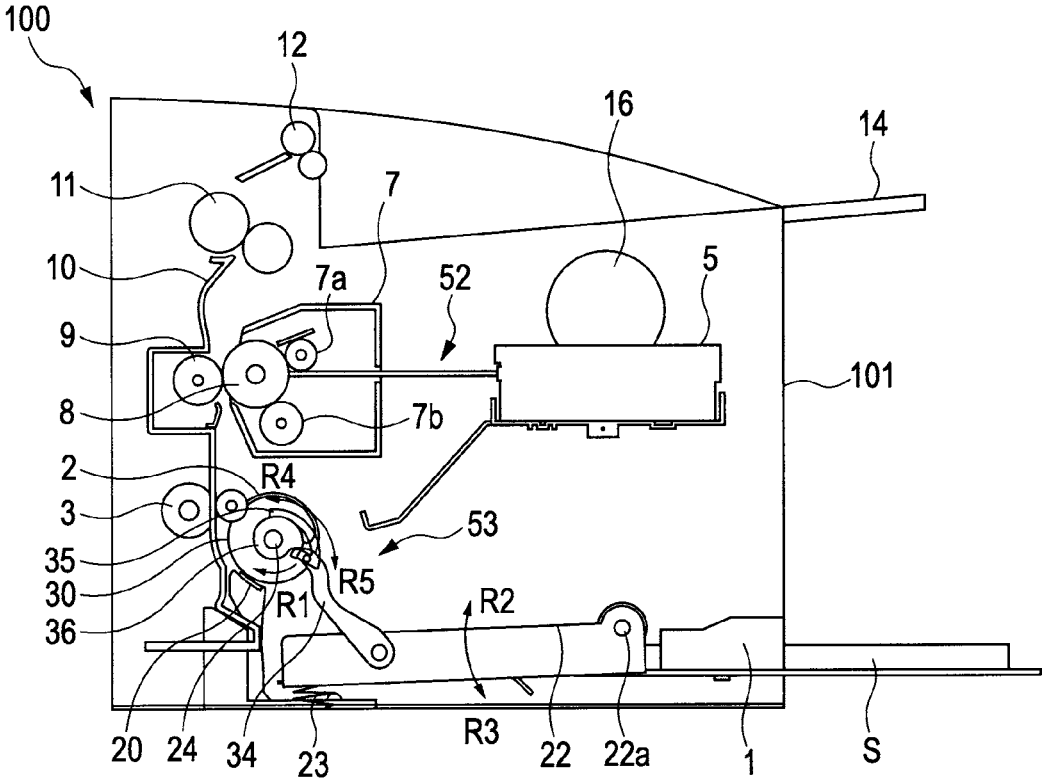
FIG. 1 illustrates a schematic configuration of a printer as an example of an image forming apparatus having a sheet feeding apparatus according to a first embodiment of the present invention.

FIG. 1 illustrates a schematic configuration of a printer 100 as an example of an image forming apparatus having a sheet feeding apparatus according to a first embodiment of the present invention. In FIG. 1, an image forming portion 52 is disposed in a printer body 101 as an image forming apparatus body and performs image formation by an electrophotographic system. A sheet feeding apparatus 53 feeds a sheet S to the image forming portion 52.

The image forming portion 52 includes a laser exposure apparatus 5, a photosensitive drum 8 for forming a toner image, a transfer roller 9 for transferring the toner image formed on the photosensitive drum 8 to a sheet S, and the like. A process cartridge 7 includes the photosensitive drum 8, a charge roller 7*a*, a developing unit 7*b*, and the like and is attachable to and detachable from a printer body 101.

The sheet feeding apparatus 53 includes a feed roller 2, a sheet tray 1 as a sheet storage portion, and a lifting plate 22 liftably disposed in the sheet tray 1 and serving as a sheet supporting member for supporting the sheet S stored in the sheet tray 1 and pressing the sheet S against the feed roller 2. As described later, when the lifting plate 22 is lifted, a feed idler roller 30 abuts against the sheet S before the sheet S abuts against the feed roller 2 located above the lifting plate 22. A drive motor 16 drives the feed roller 2 and the like.

A separation pad 20 being in press-contact with the feed roller 2 is disposed on a downstream side in a sheet feeding direction of the sheet tray 1. The sheet feeding apparatus 53 uses the feed roller 2 to feed the sheet S from the sheet tray 1 for image formation. Subsequently, the sheet feeding apparatus 53 uses the separation pad 20 being in press-contact with the feed roller 2 to separate the sheets S one by one.

Now, an image formation operation of the printer 100 will be described. When the image formation operation starts, first, a laser beam corresponding to an image signal is emitted from the laser exposure apparatus 5 to the photosensitive drum 8 whose surface is charged and which is rotatably driven clockwise. When the laser beam corresponding to the image signal is emitted, a latent image is formed on the photosensitive drum. Then, the latent image on the photosensitive drum is developed by toner supplied by a developing unit 7*b* to be visualized as a toner image.

In parallel to the toner image formation operation, the lifting plate 22 is lifted and the sheet S set in the sheet tray 1 is fed by the feed roller 2. Subsequently, the sheet S is separated one by one by the separation pad 20 to be fed substantially vertically. Then, the sheet S is conveyed to a transfer portion by a conveying roller pair 3.

Subsequently, when a voltage with the polarity opposite to that of the toner image formed on the photosensitive drum 8 is applied to the transfer roller 9 in the transfer portion, the visualized toner image on the photosensitive drum is transferred to the sheet S. Then, the sheet S to which the toner image is transferred is conveyed along a conveying guide 10 to a fixing unit 11 disposed on an upper portion of the printer body. When passed through the fixing unit 11, the sheet S is heated and pressed, whereby the toner image transferred on the sheet is fixed thereto. Subsequently, the sheet S to which the toner image is fixed is conveyed by a discharge roller pair 12 and is discharged to a discharge portion 14 provided above the printer body 101.

Figure 2:
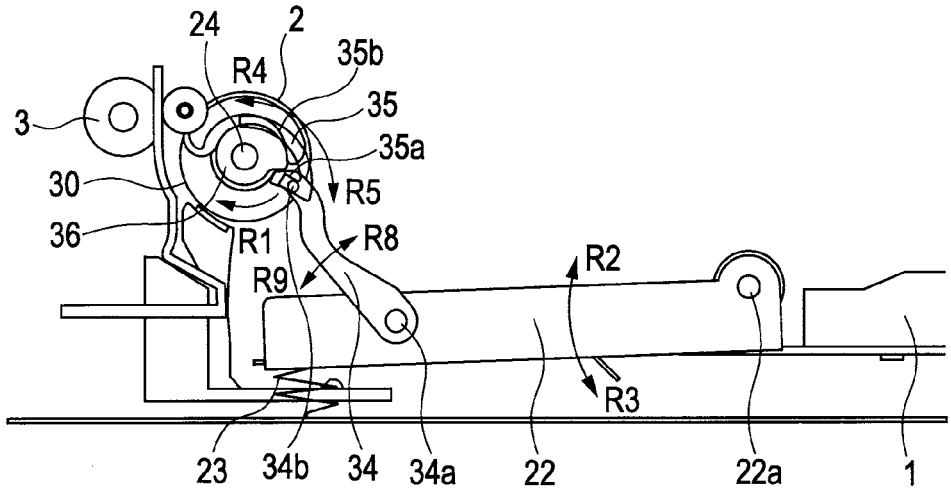
FIG. 2 is a side view describing a configuration of the sheet feeding apparatus.

FIG. 2 illustrates a configuration of the sheet feeding apparatus 53. As illustrated in FIG. 2, the lifting plate 22 on which sheets are stacked is attached to the sheet tray 1 so as to be rotatable vertically around a lifting plate boss 22*a* serving as the rotational center. The lifting plate 22 receives a biasing force in a direction of the feed roller 2 indicated by an arrow R2 from a feed spring 23 serving as a compression spring constituting a biasing portion interposed between the printer body 101 and the lifting plate 22. When the sheet feeding operation starts, the lifting plate 22 presses the stacked sheets to the feed roller 2 with a press-contact pressure of P1 by the feed spring 23. This press-contact pressure P1 is set to a level enough to feed the sheets even with a small number of sheets remaining in the sheet tray 1.

The feed roller 2 is fixed to a drive shaft 24. The drive shaft 24 is rotatably attached to a later described frame of the printer body 101 illustrated in FIG. 4. The drive shaft 24 receives a rotational driving force from a drive motor 16 through an unillustrated drive train. The feed roller 2 is a so-called half-moon shaped roller on the circumference of which a rubber member as a friction portion to the sheet is disposed at a certain angle interval. The drive shaft 24 is fixed to a feed cam 36 as a cam member serving as an example of a regulation release member for releasing regulation of a later described link member 34.

A link member 34 is supported on the lifting plate 22 and is rotatable in a vertical direction around a link member boss 34*a* serving as the rotational center. An engaging boss 34*b* is disposed in a rotation end of the link member 34. The engaging boss 34*b* is engaged with a link guide hole 35 as an arcuate shaped guide portion serving as a rotation regulating portion formed in a later described frame of the printer body 101 illustrated in FIG. 4.

This link guide hole 35 has a function of regulating the movement trajectory of the link member 34. When the feed cam 36 rotates, the link member 34 rotates vertically while moving the engaging boss 34*b* along the link guide hole 35 with rotation of the feed cam 36 as described later. According to the present embodiment, the feed cam 36, the feed spring 23, the link member 34, and the link guide hole 35 constitute the lifting portion for lifting and lowering the lifting plate 22.

Figure 3:
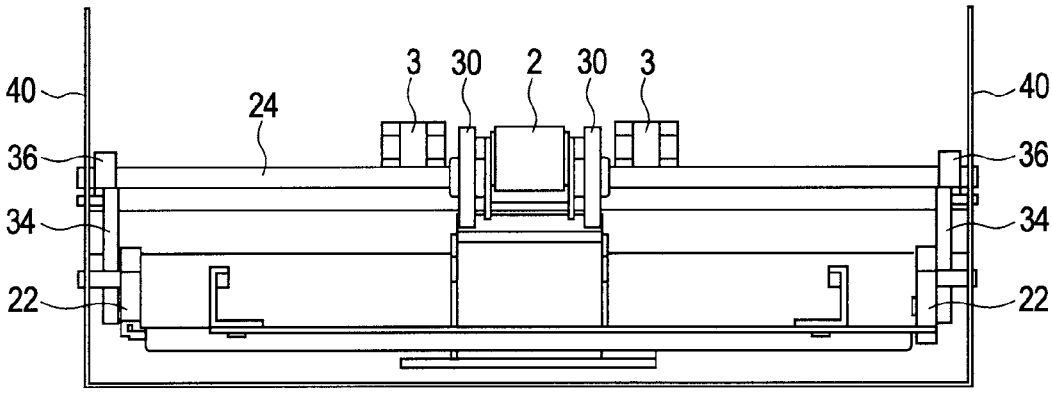
FIG. 3 is a front view describing the configuration of the sheet feeding apparatus.
Figure 4:
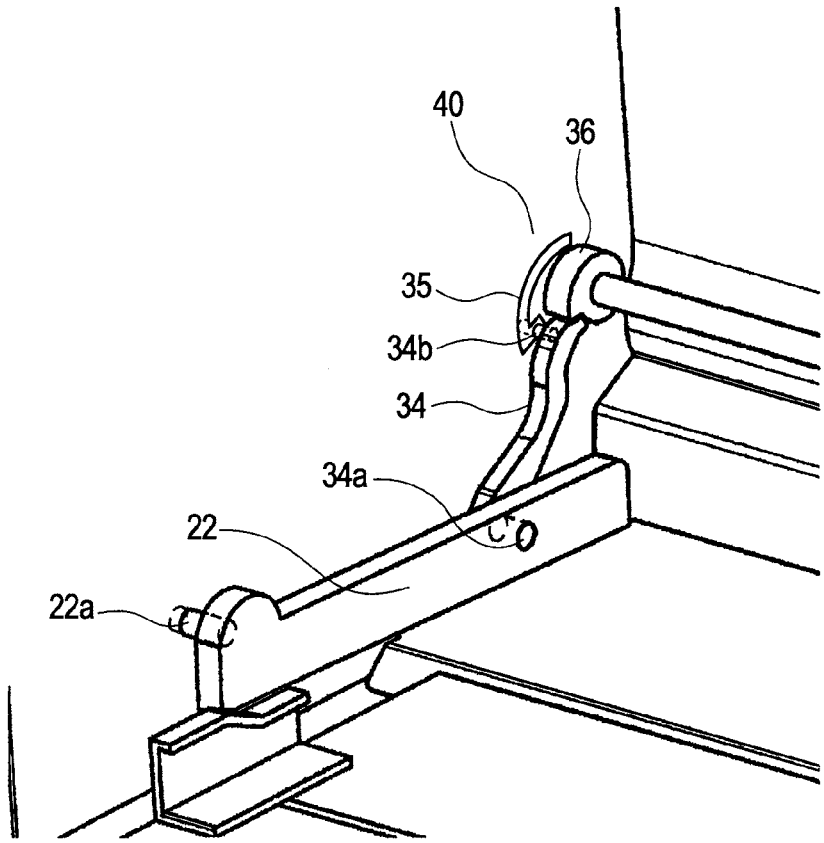
FIG. 4 is a perspective view describing the configuration of the sheet feeding apparatus.

As illustrated in FIG. 3, the link members 34 are substantially symmetrically arranged outside the sheet tray 1 around the center of the feed roller 2 disposed at the center in the width direction perpendicular to the sheet feeding direction of the sheet tray 1. As illustrated in FIG. 4, the feed cam 36 is engaged with a rotation end of the link member 34. Such an arrangement reduces the span between frames 40. Specifically, in the present arrangement, the span between frames 40 is a total of the span of the sheet tray 1 required for sheet setting and the span of the lifting portion outside thereof. The span of the lifting portion is reduced by arranging the turning fulcrums of the lifting plate 22 of the link member 34, and the feed cam 36 and the link member 34 forming the lifting portion on the same plane.

Figure 5:
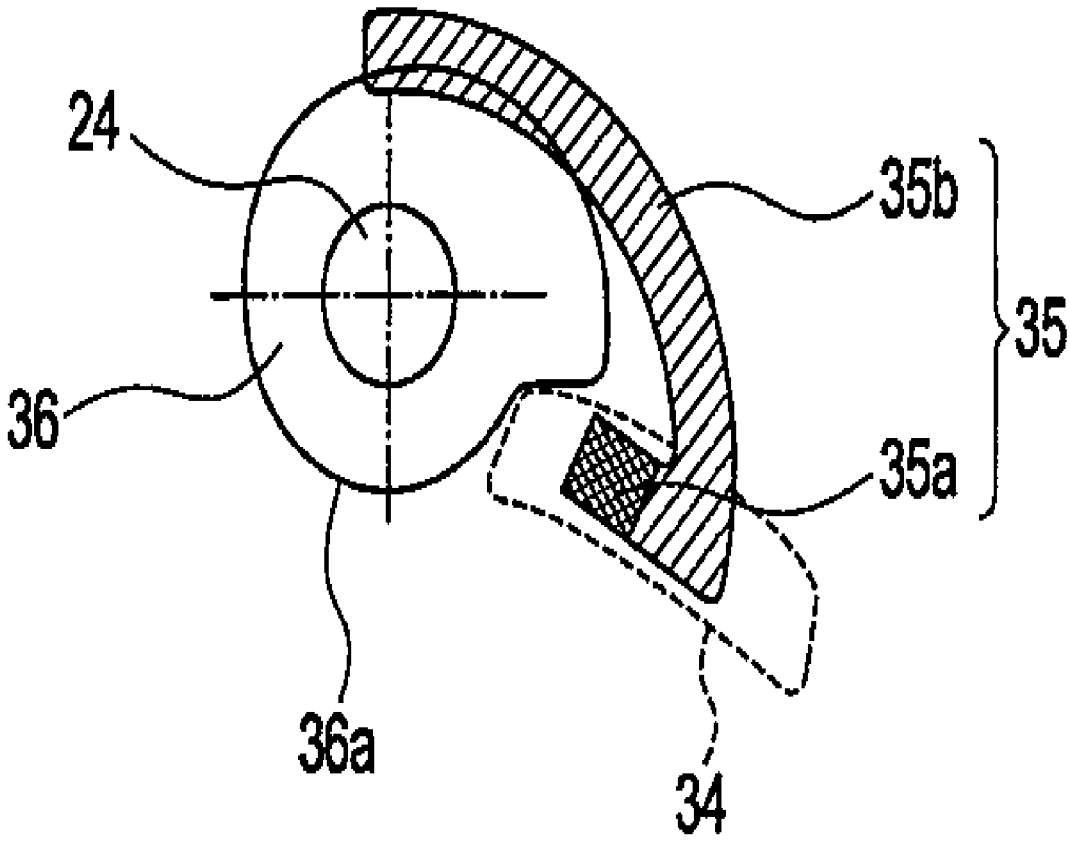
FIG. 5 illustrates the shape of a link guide hole disposed in the sheet feeding apparatus.

FIG. 5 illustrates the shape of the link guide hole 35. The link guide hole 35 includes a holding portion 35*a* (cross-hatched portion) and a guide portion 35*b* (hatched portion) for guiding the movement of the engaging boss 34*b*. The holding portion 35*a* locks the engaging boss 34*b* disposed on the side of the rotation end of the link member 34 to thereby hold the link member 34 receiving a biasing force from the feed spring 23 through the lifting plate 22 in a standby position as an initial position.

When the link member 34 locking the engaging boss 34*b* to the holding portion 35*a* is held in the standby position, the lifting plate 22 does not move upward even if the biasing force is received from the feed spring 23. In other word, the holding portion 35*a* of the link guide hole 35 has a stopper function of regulating the upward movement of the lifting plate 22.

The guide portion 35*b* forms a guide path for guiding the engaging boss 34*b* such that the link member 34 moves along a cam surface 36*a* of the feed cam 36 by the biasing force from the feed spring 23. The link member 34 moves upward and downward while moving the engaging boss 34*b* along the guide portion 35*b*. With a vertical movement of the link member 34 in conjunction with the operation of the feed cam 36, the lifting plate 22 turns (moves) upward and downward. In other word, the guide portion 35*b* of the link guide hole 35 has a guide function of guiding the turn of the lifting plate 22 in the vertical direction.

In aforementioned FIG. 2, an arrow R1 indicates a direction of rotating around the drive shaft 24. The drive shaft 24, the feed roller 2, and the feed cam 36 rotate in a direction indicated by the arrow R1. The arrows R2 and R3 indicate a direction in which the lifting plate 22 rotates around the lifting plate boss 22*a*. The arrows R4 and R5 indicate a direction in which the link member 34 turns along the link guide hole 35. The arrows R8 and R9 indicate a direction in which the link member 34 rotates around the link member boss 34*a*.

The holding portion 35*a* as a locking portion for regulating the movement of the link member 34 by locking the engaging boss 34*b* is disposed in a lower end of the guide portion 35*b*. Each time the feed cam 36 rotates once in a direction indicated by the arrow R1, the rotation end of the link member 34 in which the engaging boss 34*b* is locked by the holding portion 35*a* is pressed by the feed cam 36 to move the link member 34 toward the guide portion side, whereby the locking is released. After the link member 34 is released from locking, the link member 34 moves in a direction indicated by the arrows R4 and R5 along the guide portion 35*b* by the biasing force of the feed spring 23. Then, the lifting plate 22 performs one reciprocating motion of rotation in a direction indicated by the arrows R2 and R3 while moving the link member 34.

Figure 6A:
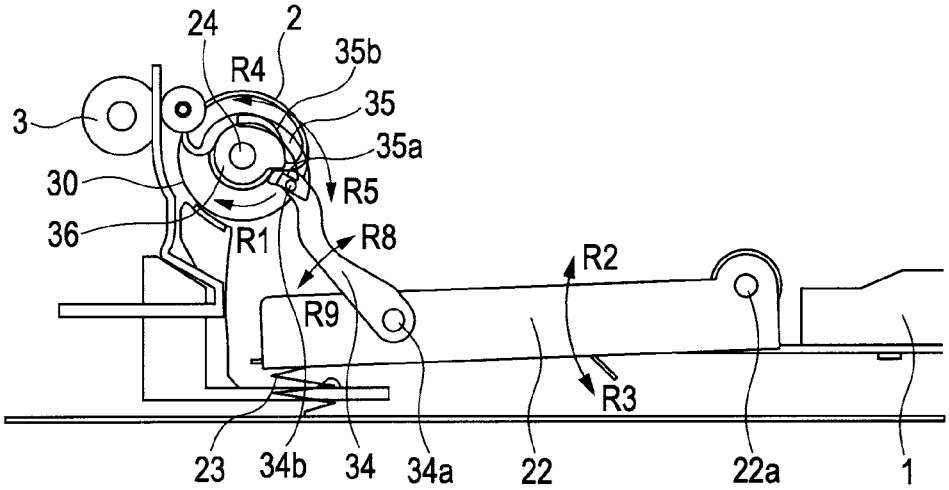
FIGS. 6A and 6B are a first diagram describing a sheet feeding operation of the sheet feeding apparatus.

Next, the sheet feeding operation of the sheet feeding apparatus 53 will be described. Before the sheet feeding operation starts, as illustrated in FIG. 6A, the feed roller 2, the feed cam 36, the link member 34, and the lifting plate 22 are in an initial feed position. Each time the sheet feeding operation is performed once, the feed roller 2, the feed cam 36, the link member 34, and the lifting plate 22 return to the initial feed position.

When the sheet feeding operation starts, first, an unillustrated solenoid is sucked and a rotational driving force in a direction indicated by the arrow R1 is transmitted from the drive motor 16 to the drive shaft 24 through an unillustrated drive train, whereby the drive shaft 24 starts rotating. Then, the feed cam 36 starts rotating integrally with the feed roller 2 fixed to the drive shaft 24 in a direction indicated by the arrow R1.

Figure 6B:
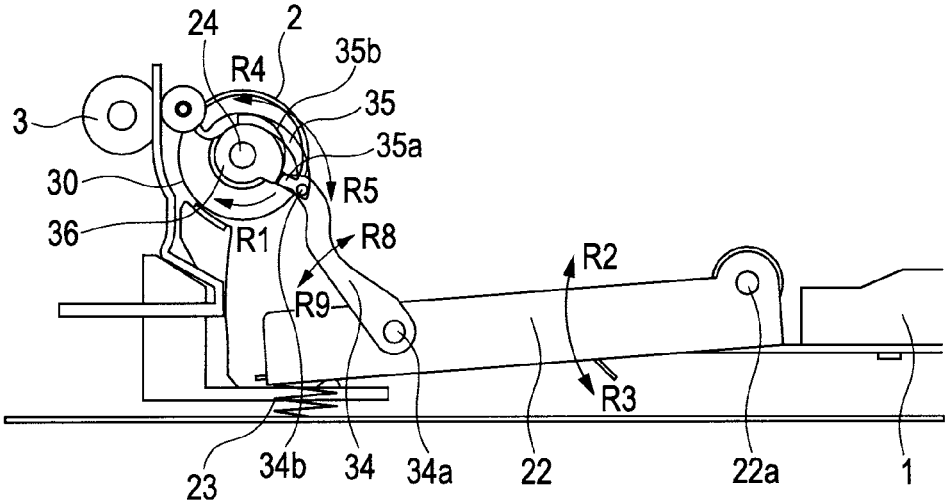
Figure 7A:
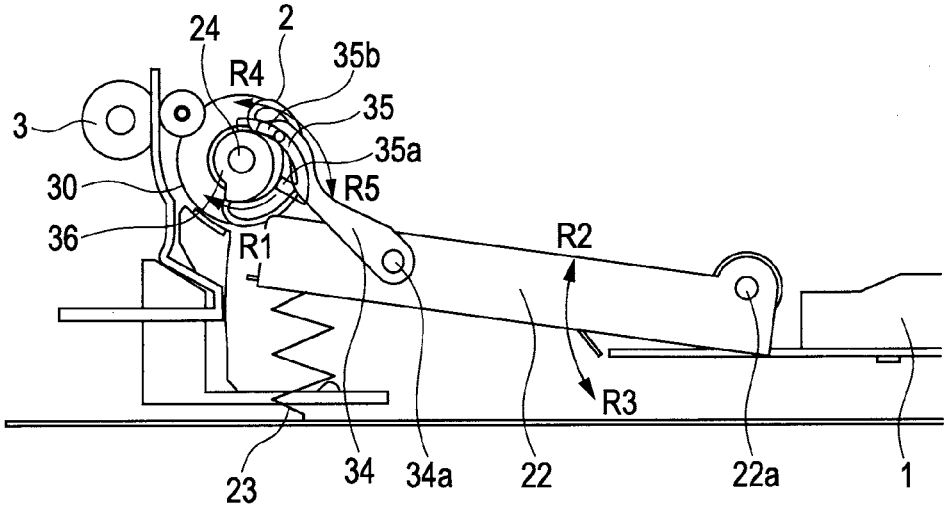
FIGS. 7A and 7B are a second diagram describing the sheet feeding operation of the sheet feeding apparatus.

When the feed cam 36 rotates, the rotation end of the link member 34 rotatably supported by the lifting plate 22 is pressed by the feed cam 36. As illustrated in FIG. 6B, the engaging boss 34*b* of the link member 34 moves from the holding portion 35*a* to the guide portion 35*b*. Then, the engaging boss 34*b* is made movable in a direction indicated by the arrow R4. When the link member 34 is movable and the lifting plate 22 receives the biasing force of the feed spring 23, as illustrated in FIG. 7A, the lifting plate 22 starts rotating upward in a direction of the feed roller 2 indicated by the arrow R2.

Figure 7B:
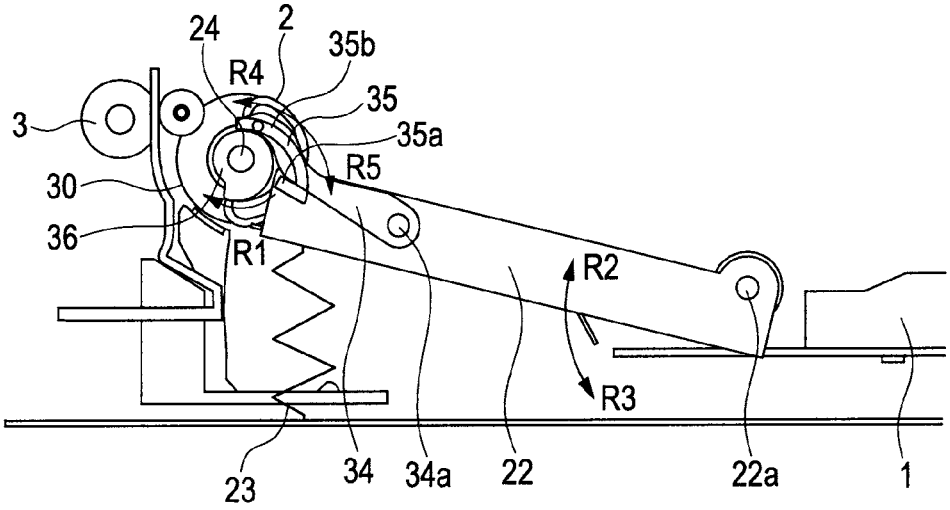

Then, when an uppermost sheet of the sheets stacked on the lifting plate 22 abuts against the feed idler roller 30, the lifting plate 22 stops rotating upward, and accordingly the link member 34 stops moving in a direction indicated by the arrow R4. When the lifting plate 22 stops and then the half-moon shaped feed roller 2 rotating together with the drive shaft 24 abuts against a position illustrated in FIG. 7B, the uppermost sheet is fed.

Figure 8:
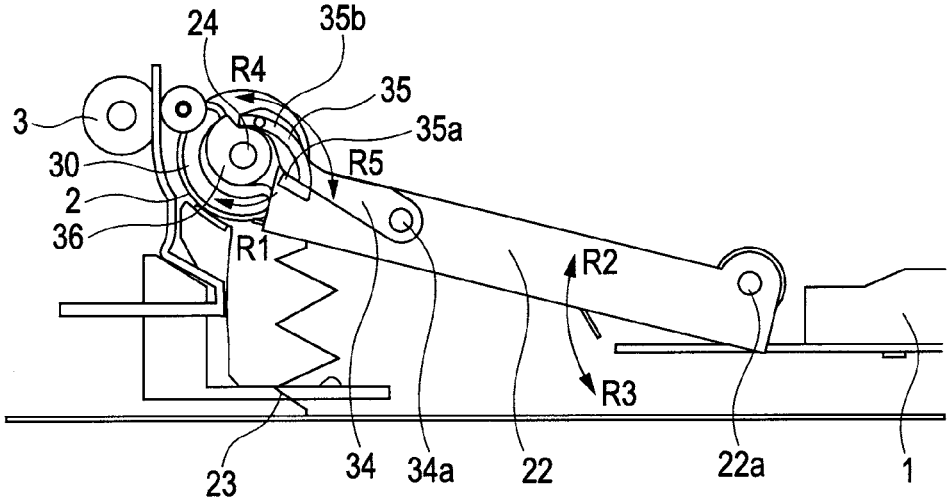
FIG. 8 is a third diagram describing the sheet feeding operation of the sheet feeding apparatus.

After the sheet feeding starts, the feed cam 36 further rotates together with the feed roller 2. As illustrated in FIG. 8, the feed cam 36 is engaged again with the rotation end of the link member 34 stopping movement and presses the link member 34. Then, the link member 34 starts moving downward while moving the engaging boss 34*b* along the guide portion 35*b* in a direction indicated by the arrow R5. After the sheet is fed, the link member 34 starts moving downward while being pressed by the feed cam 36. The driving force by the feed cam 36 is transmitted to the lifting plate 22 through the link member 34. The lifting plate 22 starts moving downward in a direction indicated by the arrow R3.

At a time when the drive shaft 24 returns to the initial position, the rotational driving force is blocked from being transmitted from the drive motor 16 to the drive shaft 24 and the feed roller 2 and the feed cam 36 stop rotating at the initial feed position illustrated in FIG. 6A. When the feed cam 36 reaches the initial feed position, the link member 34 is released from being pressed by the feed cam 36 and rotates in a direction indicated by the arrow R9 as illustrated in FIG. 6A. The engaging boss 34*b* of the link member 34 moves from the guide portion 35*b* to the holding portion 35*a*. Then, the link member 34 and the lifting plate 22 also return to the initial feed position and subsequently stop moving. Each time this operation is repeated, the sheets stacked on the sheet tray 1 are separated one by one to be fed for each rotation of the feed roller 2.

According to the present embodiment, the lifting plate 22 returns to the initial feed position once for each feeding operation. Accordingly, when printing is finished, the sheets and the feed idler roller 30 are always spaced apart from each other, whereby the user can easily stack sheets. A selection of a profile of the feed cam 36 and a profile of the link guide hole 35 can determine the rotational speed in a direction indicated by the arrows R2 and R3 of the lifting plate 22.

Figure 9A:
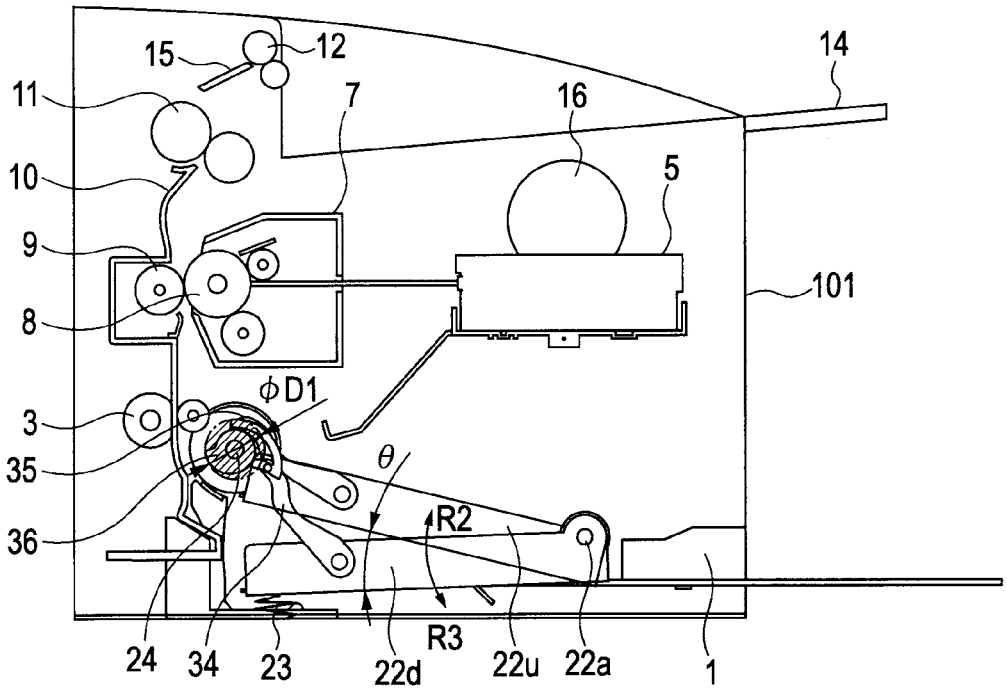
FIG. 9A and 9B describe a difference between a feed cam of the sheet feeding apparatus and a related feed cam.
Figure 9B:
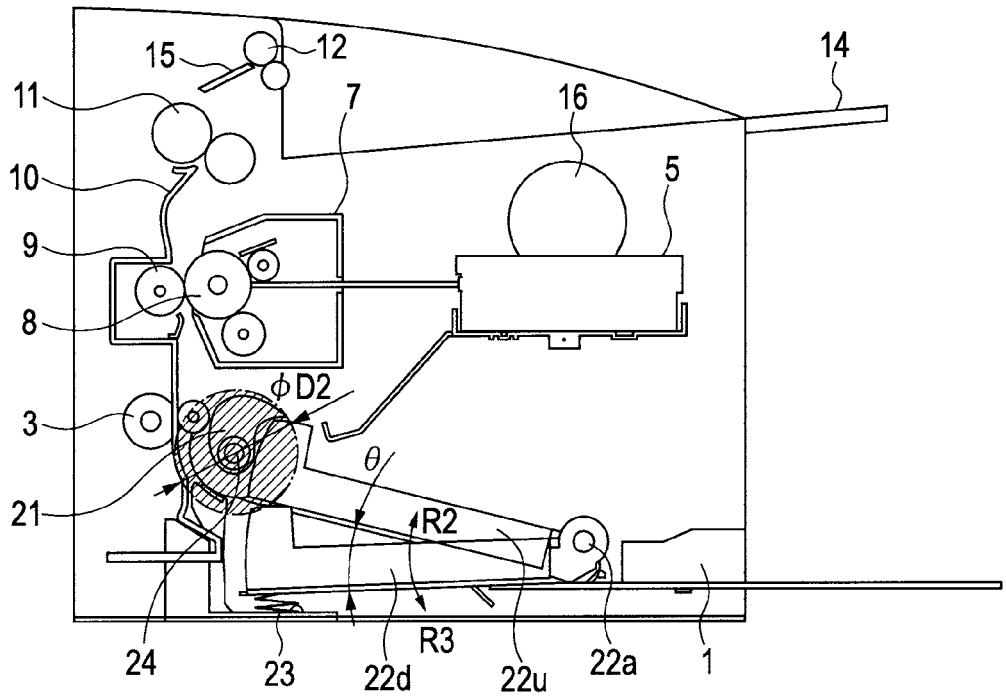

FIG. 9A illustrates a top dead center 22*u* overlapped with a bottom dead center 22*d* of the lifting plate 22 according to the present embodiment. FIG. 9B illustrates a top dead center 22*u* overlapped with a bottom dead center 22*d* of the lifting plate 22 according to a comparative example. Here, as illustrated in FIGS. 9A and 9B, both lifting plates 22 have the same rotational angle 0 between the top dead center 22*u* and the bottom dead center 22*d*.

The hatched portion illustrated in FIG. 9A indicates the rotational trajectory of the feed cam 36, and the hatched portion illustrated in FIG. 9B indicates the rotational trajectory of the feed cam 21. D1 illustrated in FIG. 9A denotes a maximum turning radius $\phi$ of the feed cam 36 according to the present embodiment and D2 illustrated in FIG. 9B denotes a maximum turning radius $\phi$ of the feed cam 21 according to the comparative example. As is apparent from FIGS. 9A and 9B, the maximum turning radius $\phi$ of the feed cam 36 is reduced to substantially half from D2 of the comparative example to Dl.

According to the present embodiment, the link member 34 is rotatably supported by the lifting plate 22, whereby when the sheet is fed, the link member 34 whose movement is regulated can be moved along the guide portion 35*b* by the feed cam 36. Thus, the maximum turning radius of the feed cam can be reduced while maintaining the same rotational angle $\theta$ of the lifting plate 22 without scarifying the stackable sheet height.

In comparison with the conventional arrangement, the present embodiment can greatly reduce the maximum turning radius of the feed cam 36 under the conditions of the same rotational angle of the lifting plate 22. As a result, even a small-sized feed cam 36 can increase the maximum number of stackable sheets. Further, a space is formed between the feed cam 36 and the peripheral components. A reduction of this space can provide a smaller-sized sheet feeding apparatus for the image forming apparatus even in the case of using the link member 34. In the case of the same-sized image forming apparatus, the present arrangement can increase the cartridge size and thus can provide an image forming apparatus having a toner cartridge having a further larger capacity.

Figure 10A:
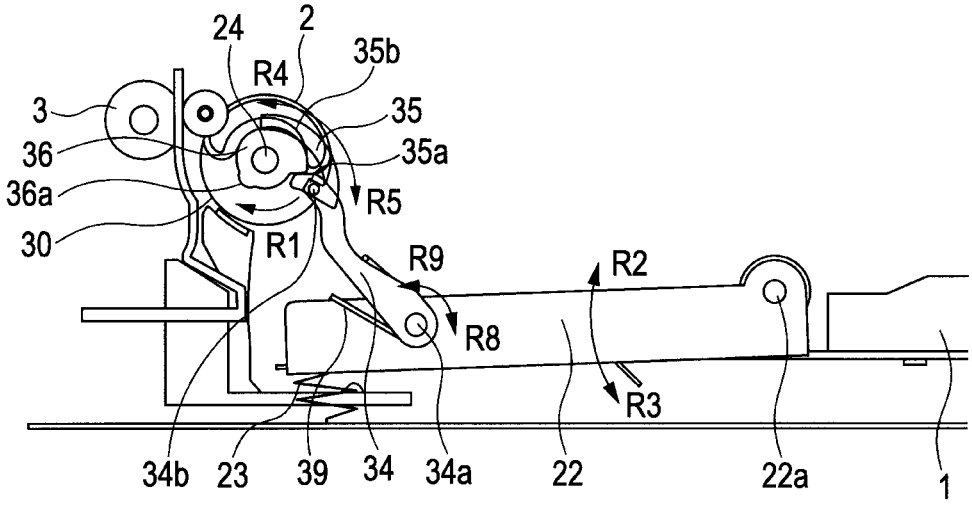
FIGS. 10A and 10B are a side view describing a configuration of a sheet feeding apparatus according to a second embodiment of the present invention.
Figure 10B:
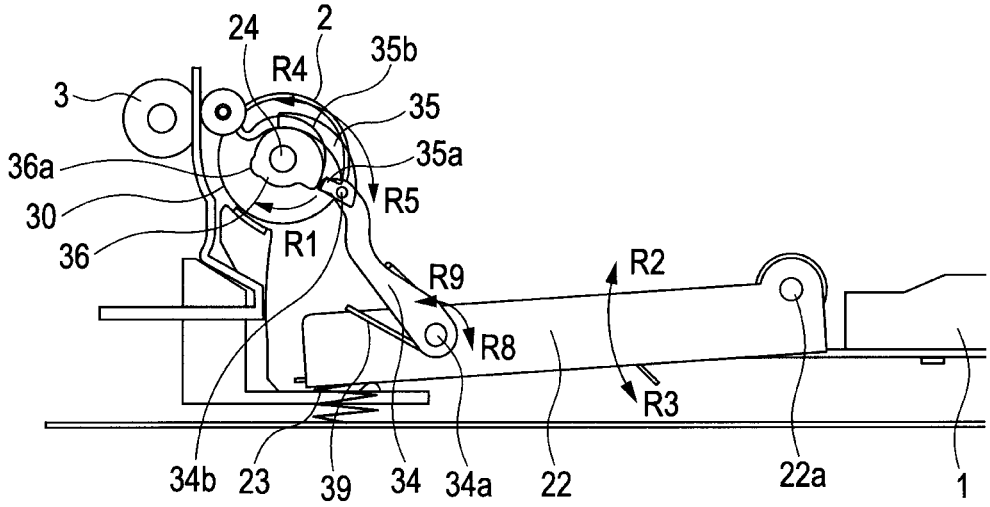

Next, a second embodiment of the present invention will be described. FIGS. 10A and 10B describe a configuration of the sheet feeding apparatus of the present embodiment. Note that the same reference numerals or characters in FIG. 2 refer to the same or identical components in FIGS. 10A and 10B.

Figure 11:
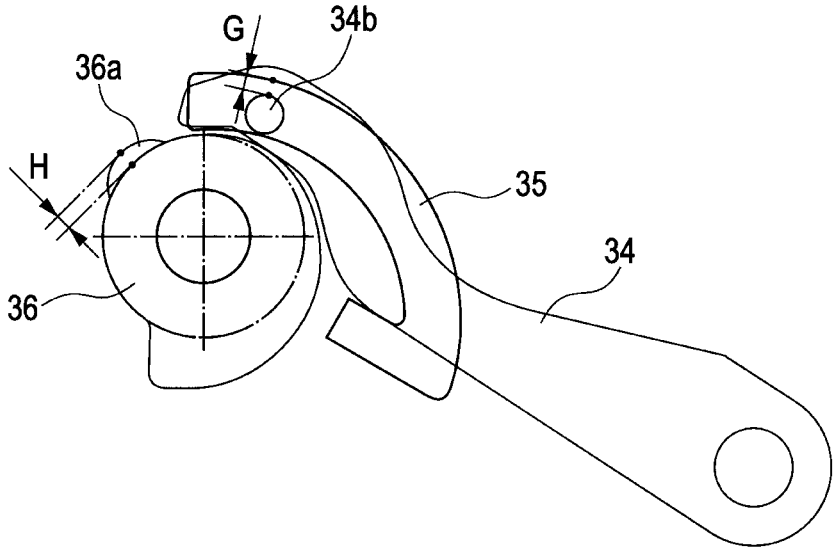
FIG. 11 describes a link guide hole and a feed cam disposed in the sheet feeding apparatus.

In FIGS. 10A and 10B, a protruding portion 36*a* is disposed on a cam surface of a feed cam 36. As illustrated in FIG. 11, the protruding portion 36*a* is protrudingly provided at a height H on the cam surface of the feed cam 36. FIG. 11 illustrates a gap G between the link guide hole 35 and the engaging boss 34*b*. According to the present embodiment, the height H of the protruding portion 36*a* and the gap G between the link guide hole 35 and the engaging boss 34*b* have a relation of $H<G$.

As illustrated in FIGS. 10A and 10B, a link spring 39 is interposed as a link member biasing member between the link member 34 and the lifting plate 22. The link spring 39 is a torsion coil spring, one end of which is locked to the link member 34 and the other end of which is locked to the lifting plate 22. The link spring 39 biases the link member 34 in a direction of rotating the link member 34 downward as illustrated by the arrow R9 with respect to the lifting plate 22.

According to the present embodiment, the feed spring 23 is a biasing member for always biasing the lifting plate 22 in a direction of the feed roller 2. The spring force of this feed spring 23 is set to be smaller than the spring force of the feed spring 23 of the first embodiment for always biasing the lifting plate 22 in a direction of the feed roller 2. More specifically, assuming that P2 is a press-contact force occurring when the lifting plate 22 and the feed roller 2 are in press-contact with each other by the feed spring 23, P2 has a relation of $P1>P2>0$. P1 denotes a press-contact pressure due to the feed spring 23 according to the aforementioned first embodiment. The relation of $P2>0$ indicates a sufficient condition for an uppermost sheet to be in contact with the feed roller when the sheets are fully stacked.

Next, the sheet feeding operation of the sheet feeding apparatus 53 will be described. Before the sheet feeding operation starts, as illustrated in FIG. 10A, the feed roller 2, the feed cam 36, the link member 34, and the lifting plate 22 are in the initial feed position. The feed roller 2, the feed cam 36, the link member 34, and the lifting plate 22 return to the initial feed position for each sheet feeding operation.

When the sheet feeding operation starts, the drive shaft 24 starts rotating. Accordingly, the feed roller 2 fixed to the drive shaft 24 and the feed cam 36 start rotating in a direction indicated by the arrow R1. A rotation of the feed cam 36 causes the rotation end of the link member 34 rotatably supported by lifting plate 22 to be pressed by the feed cam 36. As illustrated in FIG. 10B, the engaging boss 34*b* of the link member 34 moves from the holding portion 35*a* to the guide portion 35*b*.

Figure 12A:
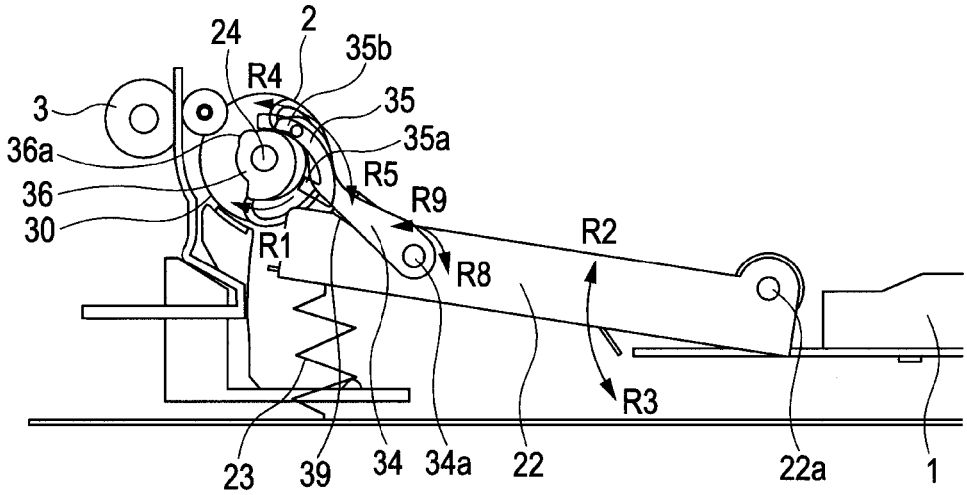
FIGS. 12A and 12B are a first diagram describing a sheet feeding operation of the sheet feeding apparatus.

Then, the engaging boss 34*b* is made movable in a direction indicated by the arrow R4. When the link member 34 is made movable, as illustrated in FIG. 12A, in response to a biasing force of the feed spring 23, the lifting plate 22 starts rotating upward in a direction of the feed roller 2 indicated by the arrow R2.

Figure 12B:
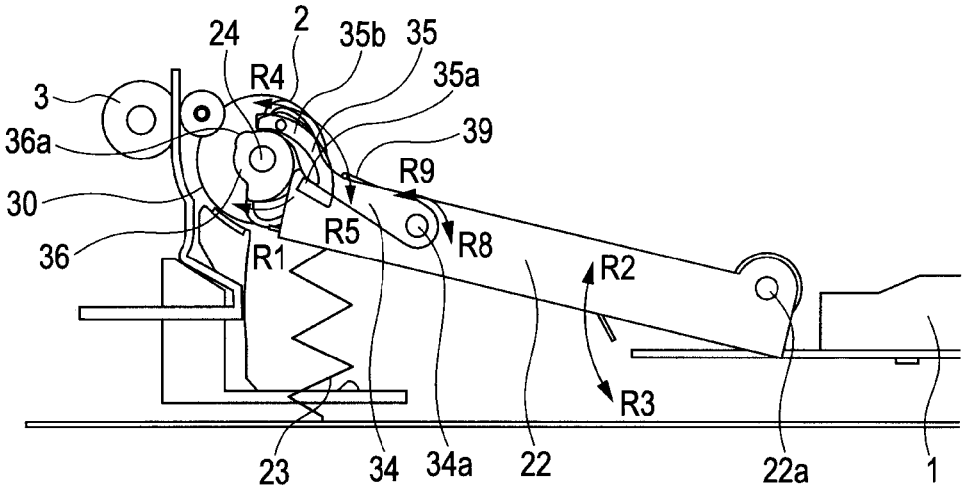

Then, when the uppermost sheet of the sheets stacked on the lifting plate 22 abuts against the feed idler roller 30, the lifting plate 22 stops rotating upward and accordingly the link member 34 stops moving in a direction indicated by the arrow R4. After the lifting plate 22 stops moving, the half-moon shaped feed roller 2 rotating together with the drive shaft 24 abuts against the uppermost sheet at a position illustrated in FIG. 12B, whereby the uppermost sheet is fed.

After the sheet feeding starts, the feed cam 36 further rotates together with the feed roller 2. The feed cam 36 is engaged again with the rotation end of the link member 34 stopping movement and presses the link member 34. Then, the link member 34 starts moving downward while moving the engaging boss 34*b* along the guide portion 35*b* in a direction indicated by the arrow R5 (see FIG. 8). When the link member 34 starts moving downward while being pressed by the feed cam 36, the driving force by the feed cam 36 is transmitted to the lifting plate 22 through the link member 34. The lifting plate 22 starts moving downward in a direction indicated by the arrow R3.

At a time when the drive shaft 24 returns to the initial position, the rotational driving force is blocked from being transmitted from the drive motor 16 to the drive shaft 24 and the feed roller 2 and the feed cam 36 stop rotating at the initial feed position illustrated in FIG. 10A. When the feed cam 36 reaches the initial feed position, pressing by the feed cam 36 is released. The link member 34 rotates in a direction indicated by the arrow R9 as illustrated in FIG. 10A, and the engaging boss 34*b* of the link member 34 moves from the guide portion 35*b* to the holding portion 35*a*. Then, the link member 34 and the lifting plate 22 also return to the initial feed position and subsequently stop moving. Each time this operation is repeated, the sheets stacked on the sheet tray 1 are separated one by one to be fed for each rotation of the feed roller 2.

Figure 13:
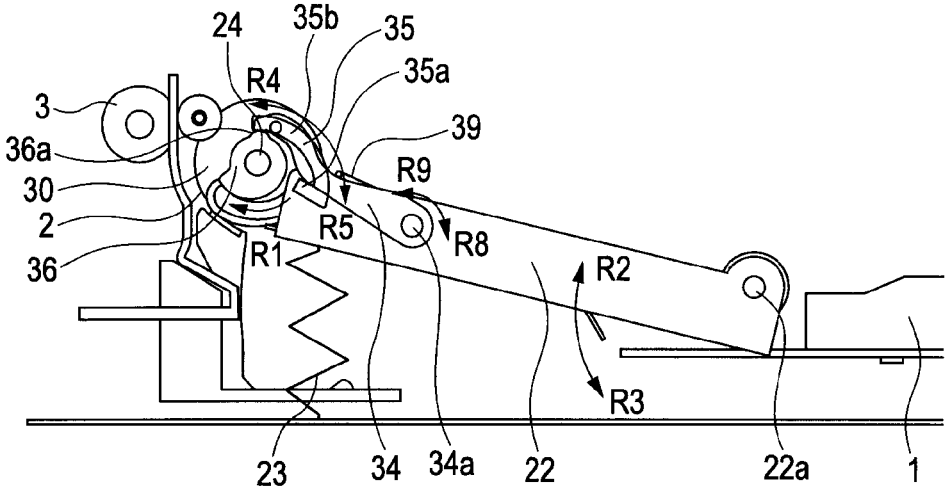
FIG. 13 is a second diagram describing the sheet feeding operation of the sheet feeding apparatus.

According to the present embodiment, when a small number of sheets are stacked, as illustrated in FIG. 13, at a timing when the feed roller 2 abuts against the uppermost sheet of the sheets stacked on the lifting plate 22, the protruding portion 36*a* of the feed cam 36 presses the link member 34. When the protruding portion 36*a* presses the link member 34, the link member 34 rotates round the link member boss 34*a* in a direction indicated by the arrow R8.

The gap G between the link guide hole 35 and the engaging boss 34*b* and the protruding height H satisfy the relation of H<G. Thus, the link member 34 pressed by the protruding portion 36*a* and rotated in a direction indicated by the arrow R8 is movable in a direction indicated by the arrow R8 without interfering with the link guide hole 35. When the link member 34 rotates, a biasing force for biasing the lifting plate 22 in a direction of the feed roller indicated by the arrow R2 is generated between the link member 34 and the lifting plate 22 by a spring force of the link spring 39.

Thus, when a small number of sheets are stacked, the press-contact pressure between the lifting plate 22 and the feed roller 2 can be increased. Specifically, an auxiliary biasing portion including the link spring 39 and the protruding portion 36*a* of the feed cam 36 generates the biasing force for biasing the lifting plate 22 in a direction of the feed roller 2 at sheet feeding. Thus, the press-contact pressure between the lifting plate 22 and the feed roller 2 at sheet feeding can be increased.

Assuming that P3 denotes the increased press-contact pressure at this time, the feed spring 23, the link spring 39, and the protruding height H are set so as to satisfy the relation: P1=P2+P3. The present embodiment includes not only the feed spring 23 but also the link spring 39 and secures P1 by the link spring 39 and the feed spring 23 at feeding the sheet. Thereby, the biasing force of the feed spring 23 can be reduced. The biasing force of the feed spring 23 depends on the feeding performance, and thus the higher the biasing force of the feed spring 23, the higher the feeding performance is.

Thus, when the press-contact pressure is secured only by the feed spring 23 like the first embodiment, the biasing force of the feed spring 23 is increased. Such an increase in the biasing force increases a contact sound occurring when the sheets stacked on the lifting plate 22 abut against the feed idler roller 30. On the contrary to this, when P1 is secured by the link spring 39 and the feed spring 23 like the present embodiment, the biasing force of the feed spring 23 can be reduced, whereby the contact sound can be reduced.

More specifically, according to the present embodiment, after the feed idler roller 30 abuts against the lifting plate 22 or a sheet stacked on the lifting plate 22, the protruding portion 36*a* of the feed cam 36 presses the link member 34. Thereby, a biasing force in a direction indicated by the arrow R2 occurs in the lifting plate 22, whereby after the feed idler roller 30 abuts against the lifting plate 22 or a sheet stacked thereon, the biasing force between the lifting plate 22 and the feed roller 2 can be increased again.

This will be described from the point of view of the press-contact pressure between the feed roller 2 and the lifting plate 22. According to the first embodiment, the press-contact pressure between the feed roller 2 and the lifting plate 22 by the feed spring 23 is P1 as a press-contact pressure satisfying the feeding performance. According to the present embodiment, the press-contact pressure P2 between the feed roller 2 and the lifting plate 22 by the feed spring 23 is smaller than P1. Thus, the contact sound can be reduced.

However, since P2 has a relation of P1>P2 due to the formula, the feeding performance is reduced only by the feed spring 23. To compensate for it, the press-contact pressure is increased again by the link spring 39 and the protruding portion 36*a* of the feed cam 36 to generate the press-contact pressure P3. This can compensate for an insufficient press-contact pressure due to the relation of P1>P2 and can secure a sufficient feeding performance.

As described above, according to the present embodiment, when the link member 34 rotates, the link spring 39 and the protruding portion 36*a* of the feed cam 36 biases the lifting plate 22. Thus, the present embodiment can provide a sheet feeding apparatus for a smaller-sized low-noise image forming apparatus.

According to the first and second embodiments, the link guide hole 35 is formed on the frame, but the link guide hole 35 may be formed on any member as long as the member has a function of regulating the link tip trajectory. The position of the link member boss 34*a* is a specific point of the lifting plate 22, but any place may be suitable as long as the place is on the lifting plate 22. In this case, the maximum turning radius of the feed cam 36 can be determined by selecting the position of the link member boss 34*a*.

The arrangement is such that under the conditions of setting the rotational angle θ of the lifting plate 22 to the same, the maximum turning radius of the feed cam is reduced, but another arrangement under the conditions of setting the maximum turning radius of the feed cam to the same may be suitable as well. In this case, the rotational angle θ of the lifting plate 22 can be increased by providing the link member 34, whereby a sheet feeding apparatus capable of stacking a larger number of sheets thereon can be provided. A hole may be provided in the link member and a boss may be provided in the frame.

Figure 14:
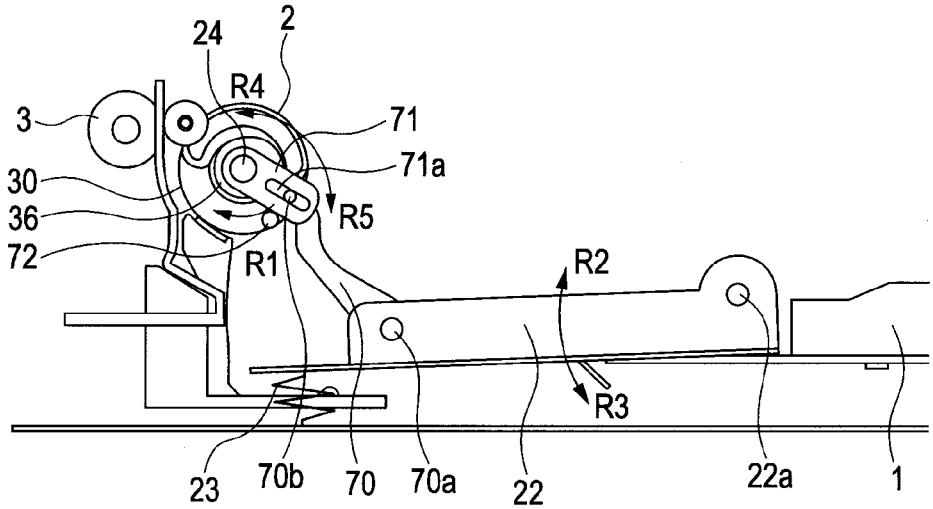
FIG. 14 is a side view describing a configuration of a sheet feeding apparatus according to a third embodiment of the present invention.

Next, a third embodiment of the present invention will be described. FIG. 14 describes a configuration of a sheet feeding apparatus according to the present embodiment. Note that the same reference numerals or characters in FIG. 2 refer to the same or identical components in FIG. 14.

In FIG. 14, the link member 70 is rotatably supported by the lifting plate 22 around the link member boss 70*a*. A guide member 71 as a rotation regulating portion is rotatably provided around the drive shaft 24 in a direction indicated by the arrow R1 and in the opposite direction thereof. A guide member hole 71*a* forming a long groove is provided in the guide member 71. The movement of the link member 70 is regulated by engaging the guide member hole 71*a* with a boss 70*b* provided in a rotation end of the link member 70. A guide member stopper 72 is provided in the frame to regulate the rotation angle of the guide member 71. The drive shaft 24, the feed cam 36, the link member 70, the guide member 71, and the guide member stopper 72 form a lifting portion for lifting and lowering the lifting plate 22.

Figure 15A:
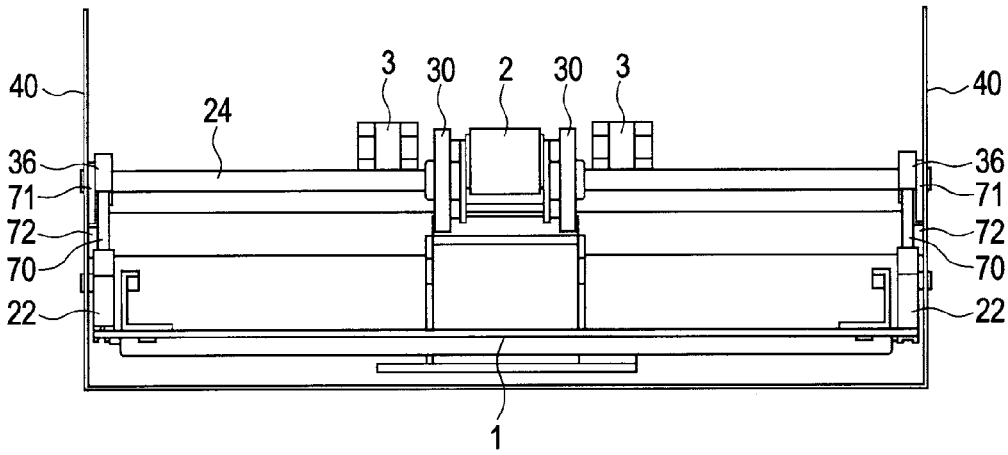
FIG. 15A is a front view describing the configuration of the sheet feeding apparatus.
Figure 15B:
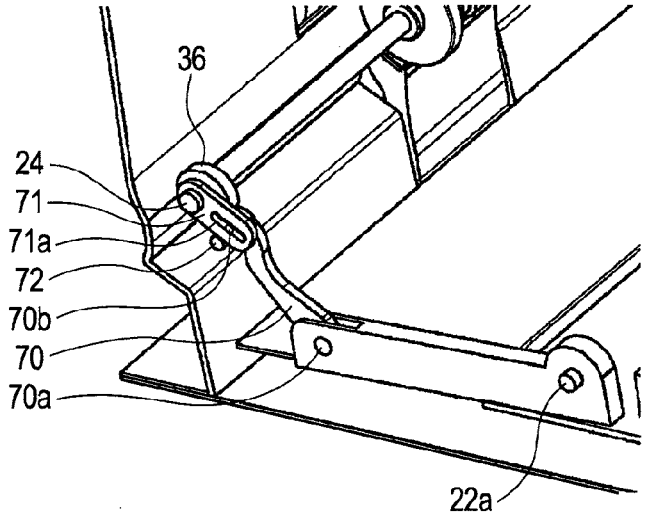
FIG. 15B is a perspective view describing the configuration of the sheet feeding apparatus.

As illustrated in FIGS. 15A and 15B, the feed cams 36, the link members 70, the guide members 71, and the guide member stoppers 72 are substantially symmetrically arranged around the feed roller 2. The link members 70 are arranged outside the sheet tray 1, and the feed cams 36 are arranged in positions engaged with the respective link members 70. The guide member 71 is interposed between the link member 70 and the frame 40 so as to be rotatably supported by the drive shaft 24. The guide member stopper 72 is arranged as a cylindrical boss fixed to the frame 40 in a position in contact with the guide member 71.

Thus, each time the feed cam 36 rotates in a direction indicated by the arrow R1, the lifting plate 22 reciprocates once in a direction indicated by the arrow R2 and in a direction indicated by the arrow R3 as illustrated in FIG. 14. In other word, a rotation of the feed cam 36 determines the position of the lifting plate 22 through the link member 70.

Figure 16A:
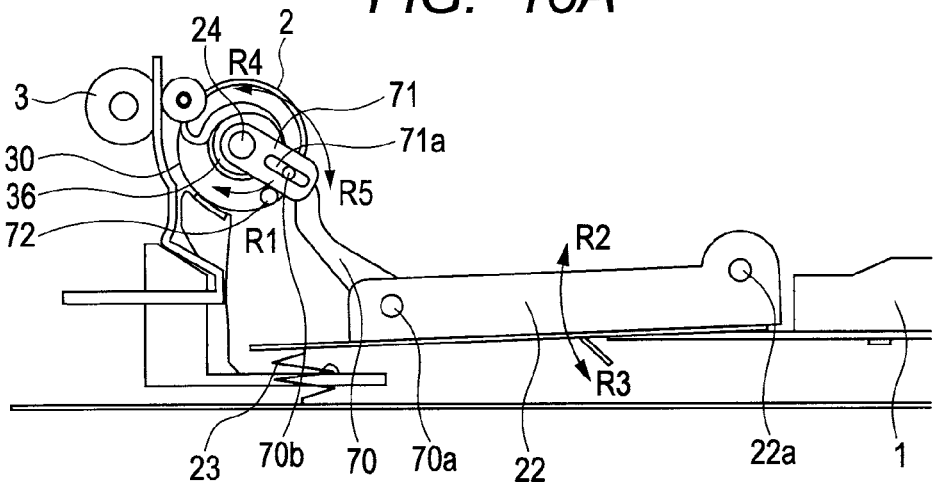
FIGS. 16A, 16B and 16C are a first diagram describing a sheet feeding operation of the sheet feeding apparatus.

Next, with reference to FIGS. 16A, 16B, 17A and 17B, the operation of the sheet feeding apparatus according to the present embodiment will be described. FIG. 16A illustrates a state in which the feed roller 2, the feed cam 36, the link member 70, the guide member 71, and the lifting plate 22 are in the initial feed position. Each time the sheet feeding operation is performed, the feed roller 2, the feed cam 36, the link member 70, the guide member 71, and the lifting plate 22 return to the initial feed position.

Figure 16B:
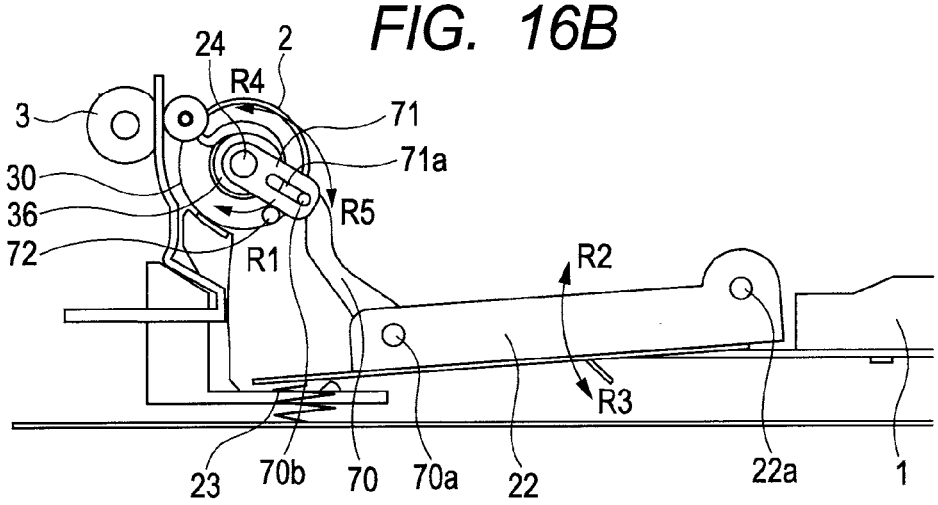

The sheet feeding operation starts and then a signal is input from an electric board to an unillustrated solenoid. The drive shaft 24 starts rotating and the feed roller 2 fixed to the drive shaft 24 and the feed cam 36 start rotating in a direction indicated by the arrow R1. When the feed cam 36 rotates, the link member 70 engaged with the feed cam 36 moves along the trajectory of the guide member hole 71*a*. At this time, the guide member 71 does not rotate in a direction indicated by the arrow R1 because the guide member 71 is in contact with the guide member stopper 72. As illustrated in FIG. 16B, the link member 70 is made movable in a direction indicated by the arrow R4.

Figure 16C:
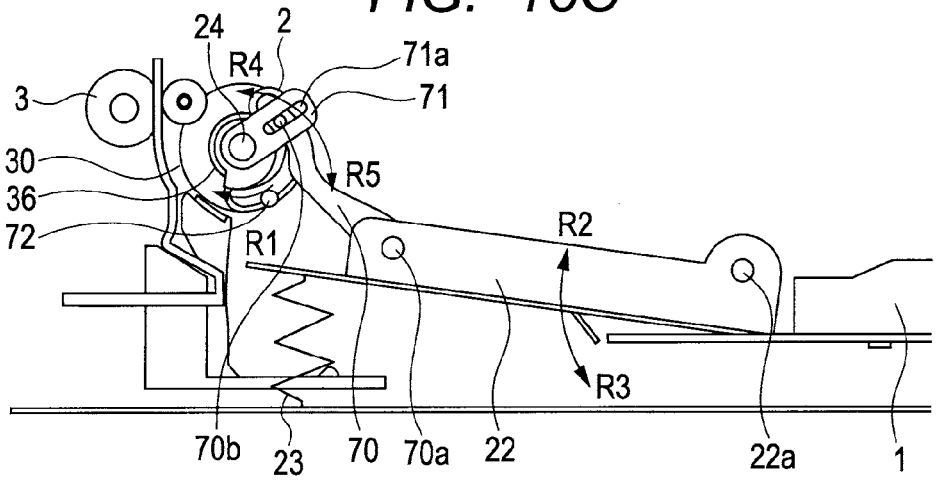

The link member 70 is rotatably supported by the lifting plate 22. Thus, when the link member 70 is made movable in a direction indicated by the arrow R4, in response to the biasing force of the feed spring 23, the lifting plate 22 starts rotating in a direction indicated by the arrow R2 as illustrated in FIG. 16C. When the link member 70 moves in a direction indicated by the arrow R4, the guide member 71 also rotates integrally with the link member 70 in a direction opposite to the direction indicated by the arrow R1.

Then, when the uppermost sheet of the sheets stacked on the lifting plate 22 abuts against the feed idler roller 30, the lifting plate 22 stops rotating upward and accordingly the link member 70 stops moving in a direction indicated by the arrow R4. After the lifting plate 22 stops moving, the half-moon shaped feed roller 2 rotating together with the drive shaft 24 abuts against the uppermost sheet and accordingly the uppermost sheet is fed.

Figure 17A:
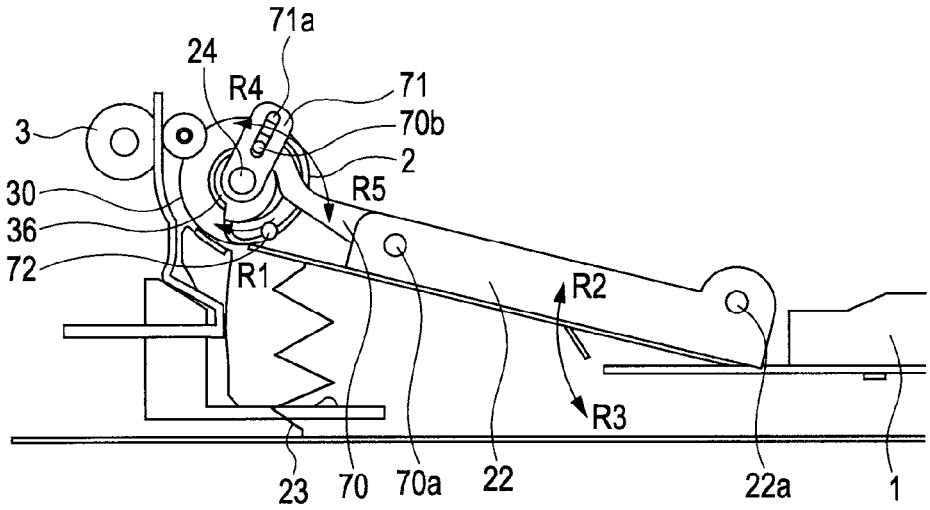
FIGS. 17A and 17B are a second diagram describing the sheet feeding operation of the sheet feeding apparatus.

After the sheet feeding starts, the feed cam 36 further rotates together with the feed roller 2. As illustrated in FIG. 17A, the feed cam 36 is engaged again with the rotation end of the link member 70 stopping movement and presses the link member 70. Then, the link member 70 starts moving in a direction indicated by the arrow R5. The guide member 71 also starts moving integrally with the link member 70 in a direction indicated by the arrow R5.

Figure 17B:
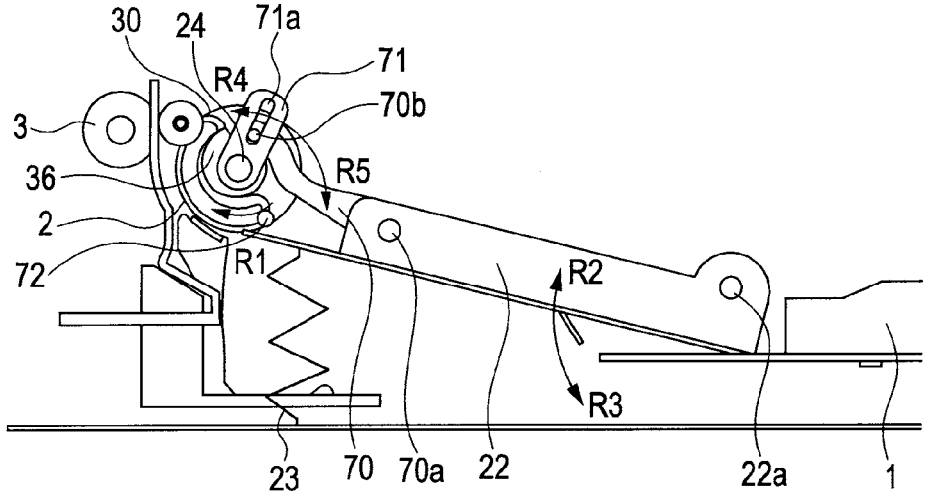

When the link member 70 rotates, as illustrated in FIG. 17B, the lifting plate 22 starts rotating in a direction indicated by the arrow R3. At a time when the drive shaft 24 returns to the initial feed position, the rotational driving force is blocked from being transmitted to the drive shaft 24 and the feed roller 2 and the feed cam 36 stop rotating at the initial feed position. When the feed cam 36 reaches the initial feed position, the link member 70, the guide member 71, and the lifting plate 22 also return to the initial feed position illustrated in FIG. 16A and then stop moving. Each time this operation is repeated, the sheets stacked on the sheet tray 1 are separated one by one to be fed for each rotation of the feed roller 2.

According to the present embodiment, the link member boss 70*b* is guided by the guide member 71. In other word, the link member boss 70*b* and the guide member 71 slide. In comparison with the case in which the link member boss 70*b* is moved along the link guide hole 35, the present embodiment can reduce the load applied to the link member boss 70*b* and thus can provide a sheet feeding apparatus with higher durability.

Figure 18:
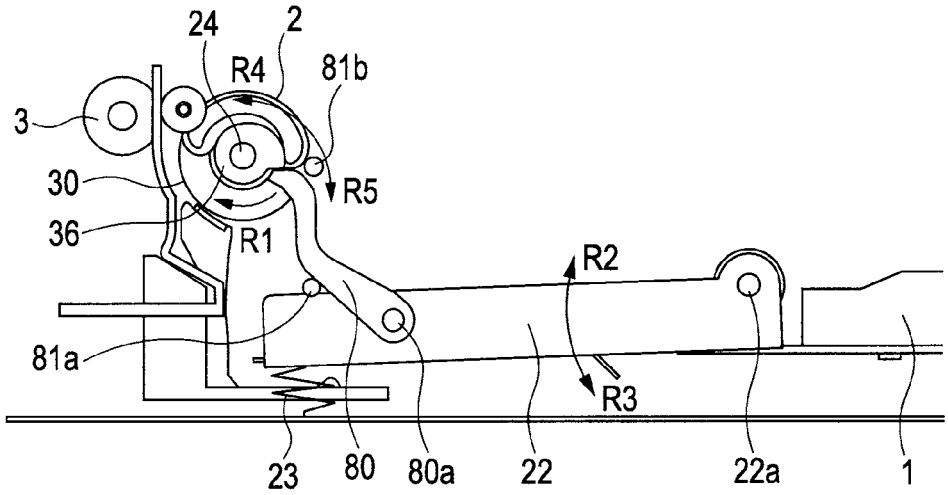
FIG. 18 is a side view describing a configuration of a sheet feeding apparatus according to a fourth embodiment of the present invention.

Next, a fourth embodiment of the present invention will be described. FIG. 18 describes a configuration of a sheet feeding apparatus according to the present embodiment. Note that the same reference numerals or characters in FIG. 2 refer to the same or identical components in FIG. 18.

In FIG. 18, the link member 80 is rotatably supported by the lifting plate 22 around the link member boss 80*a*. A pair of guide bosses 81*a* and 81*b* are disposed in a frame and serve as a rotation regulating portion for regulating the movement trajectory (rotation) of the link member 80. The guide bosses 81*a* and 81*b* are disposed on respective opposite sides of the link member 80 so as to be engaged with an outer peripheral portion of the link member 80 when the link member 80 moves. The drive shaft 24, the feed cam 36, the link member 80, and the guide bosses 81*a* and 81*b* configure a lifting portion for lifting and lowering the lifting plate 22.

Figure 19A:
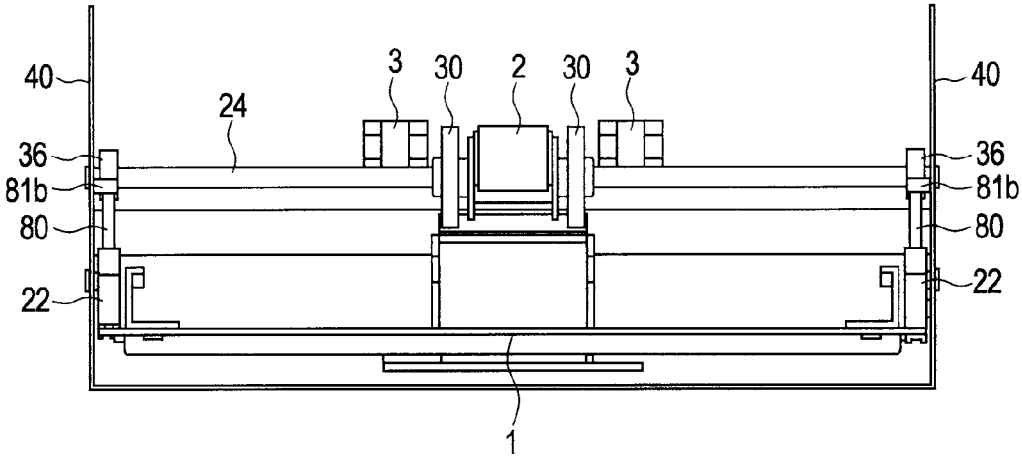
FIG. 19A is a front view describing the configuration of the sheet feeding apparatus.
Figure 19B:
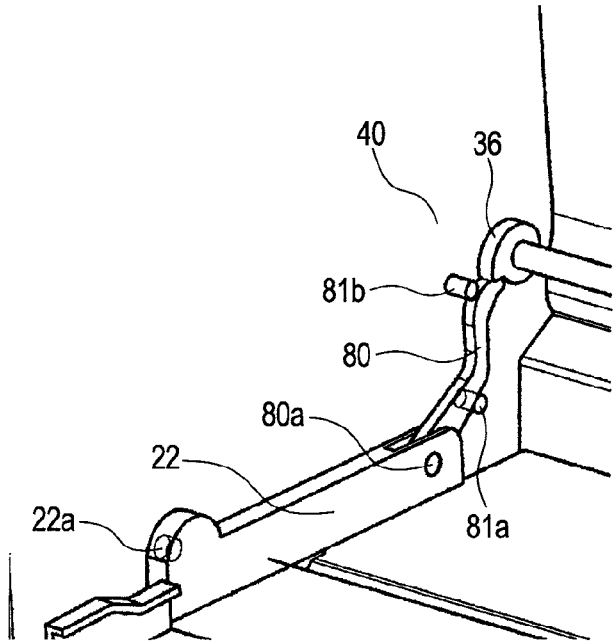
FIG. 19B is a perspective view describing the configuration of the sheet feeding apparatus.

As illustrated in FIGS. 19A and 19B, the feed cams 36, the link members 80, and the guide bosses 81*a* and 81*b* are substantially symmetrically arranged around the feed roller 2.

The link members 80 are arranged outside the sheet tray 1, and the feed cams 36 are arranged in positions engaged with the respective link members 80. Thus, each time the feed cam 36 rotates in a direction indicated by the arrow R1, the lifting plate 22 reciprocates once in a direction indicated by the arrow R2 and in a direction indicated by the arrow R3 as illustrated in FIG. 18. In other word, a rotation of the feed cam 36 determines the position of the lifting plate 22 through the link member 80.

Figure 20A:
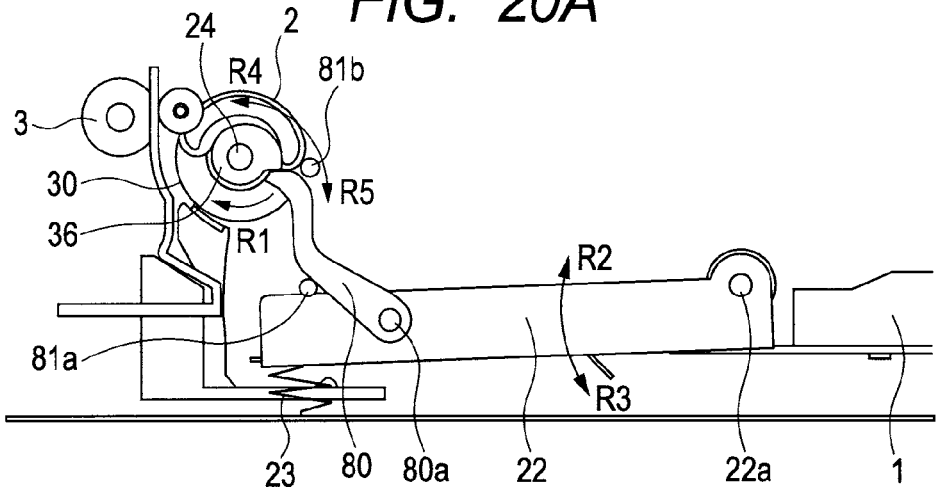
FIGS. 20A, 20B and 20C are a first diagram describing a sheet feeding operation of the sheet feeding apparatus.

Next, with reference to FIGS. 20A, 20B, 20C, 21A and 21B, the operation of the sheet feeding apparatus according to the present embodiment will be described. FIG. 20A illustrates a state in which the feed roller 2, the feed cam 36, the link member 80, and the lifting plate 22 are in the initial feed position. Each time the sheet feeding operation is performed, the feed roller 2, the feed cam 36, the link member 80, and the lifting plate 22 return to the initial feed position.

Figure 20B:
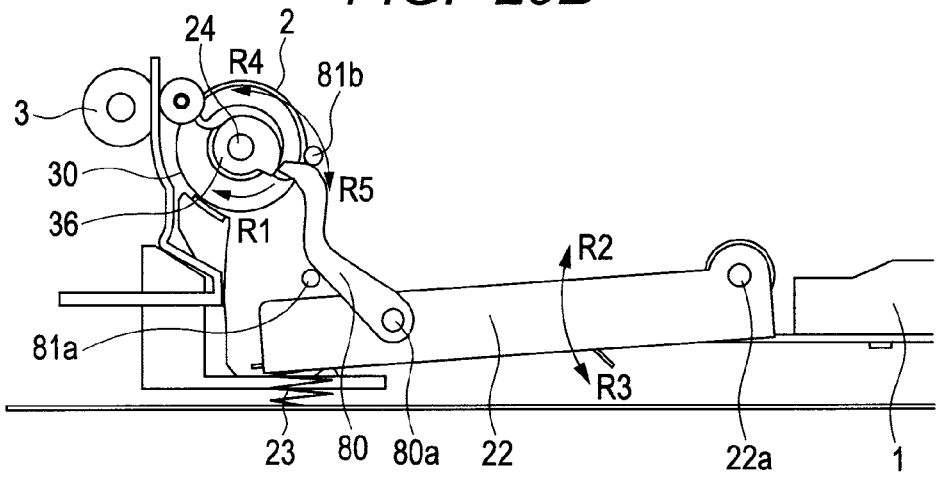

The sheet feeding operation starts and then a signal is input from an electric board to an unillustrated solenoid. Then, the drive shaft 24 starts rotating and the feed roller 2 fixed to the drive shaft 24 and the feed cam 36 start rotating in a direction indicated by the arrow R1. When the feed cam 36 rotates, the link member 80 engaged with the feed cam 36 moves in sliding contact with the guide bosses 81*a* and 81*b*. At this time, the guide boss 81*a* does not rotate in a direction indicated by the arrow R1 because the guide boss 81*a* is fixed to the frame 40. Thus, as illustrated in FIG. 20B, the link member 80 is made movable in a direction indicated by the arrow R4.

Figure 20C:
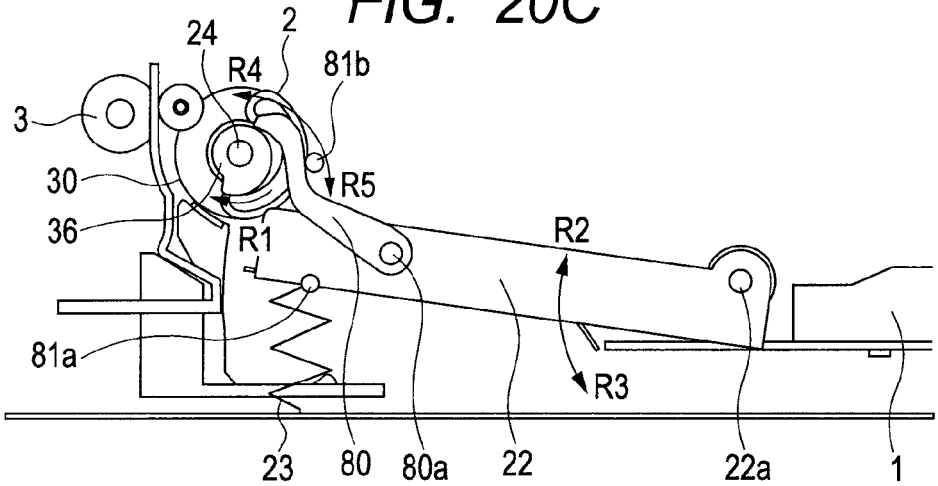

The link member 80 is rotatably supported by the lifting plate 22. Thus, when the link member 80 is made movable in a direction indicated by the arrow R4, as illustrated in FIG. 20C, in response to a biasing force of the feed spring 23, the lifting plate 22 starts rotating in a direction indicated by the arrow R2. Then, when the uppermost sheet of the sheets stacked on the lifting plate abuts against the feed idler roller 30, the lifting plate 22 stops rotating upward and accordingly the link member 80 stops moving in a direction indicated by the arrow R4. After the lifting plate 22 stops moving, the half-moon shaped feed roller 2 rotating together with the drive shaft 24 abuts against the uppermost sheet and accordingly the uppermost sheet is fed.

Figure 21A:
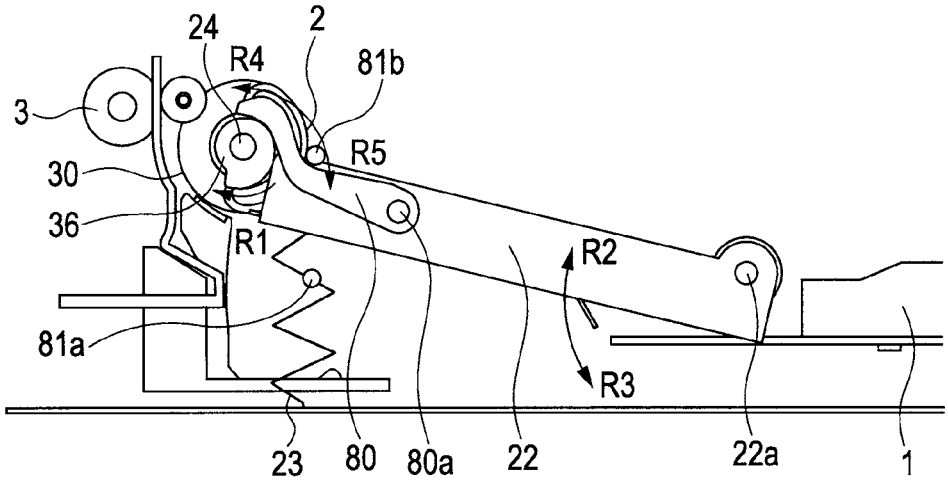
FIGS. 21A and 21B are a second diagram describing the sheet feeding operation of the sheet feeding apparatus.

After the sheet feeding starts, the feed cam 36 further rotates together with the feed roller 2. As illustrated in FIG. 21A, the feed cam 36 is engaged again with the rotation end of the link member 80 stopping movement and presses the link member 80. Then, the link member 80 starts moving in a direction indicated by the arrow R5.

Figure 21B:
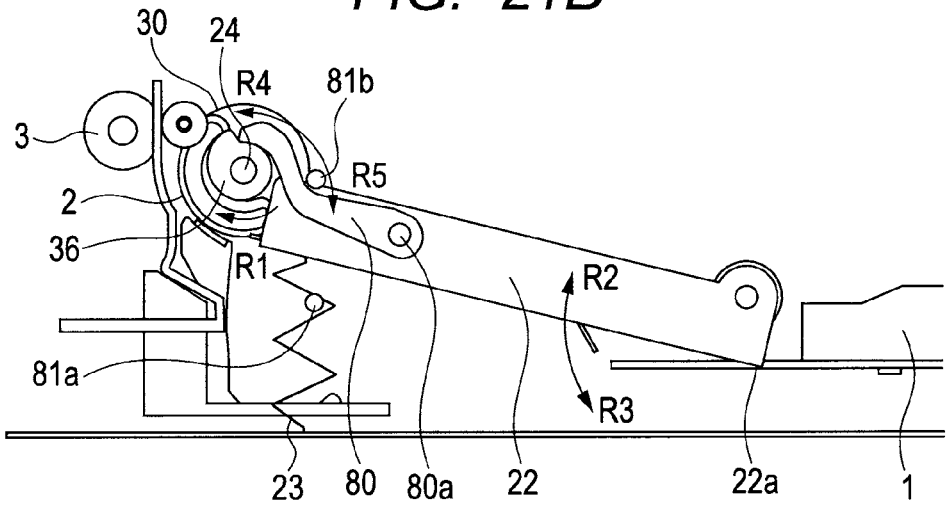

When the link member 80 rotates, as illustrated in FIG. 21B, the lifting plate 22 starts rotating in a direction indicated by the arrow R3. At a time when the drive shaft 24 returns to the initial feed position, the rotational driving force is blocked from being transmitted to the drive shaft 24 and the feed roller 2 and the feed cam 36 stop rotating at the initial feed position. When the feed cam 36 reaches the initial feed position, the link member 80 and the lifting plate 22 also return to the initial feed position illustrated in FIG. 20A and then stop moving. Each time this operation is repeated, the sheets stacked on the sheet tray 1 are separated one by one to be fed for each rotation of the feed roller 2.

According to the present embodiment, the movement of the link member 80 is guided (regulated) by the guide bosses 81*a* and 81*b*. Thus, the present embodiment can reduce the load applied to the link member 80 and thus can provide a sheet feeding apparatus with higher durability.

The aforementioned description has focused on the lifting portion such that the feed cam as the regulation release member is provided on the drive shaft to make the link member movable by rotation of the feed cam to thereby lift and lower the lifting plate, but the present invention is not limited to this. For example, the lifting portion may be such that as an example of the regulation release member making the link member movable, a crank portion is provided on the drive shaft to make the link member movable by rotation of the crank portion to thereby lift and lower the lifting plate.

Figure 22:
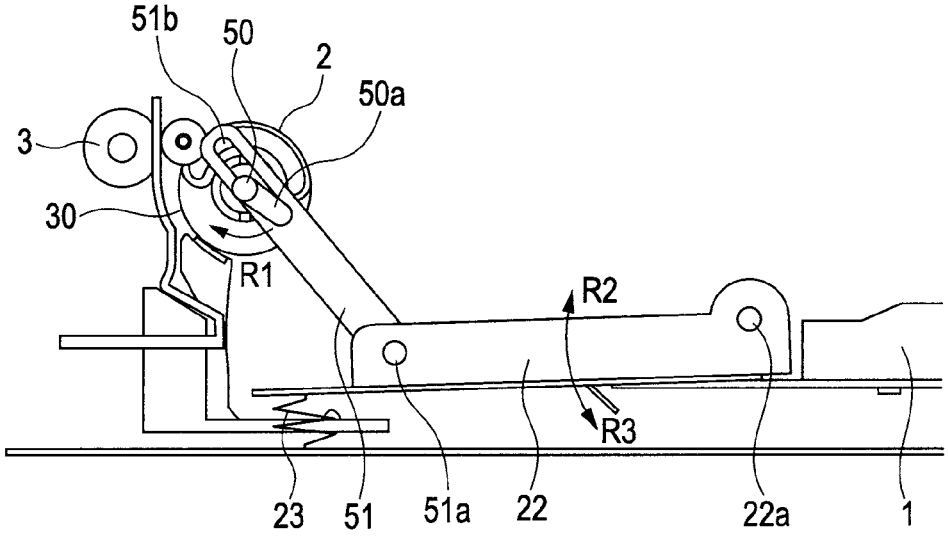
FIG. 22 is a side view describing a configuration of a sheet feeding apparatus according to a fifth embodiment of the present invention.

Next, a fifth embodiment of the present invention will be described. The fifth embodiment provides a crank portion on a drive shaft to lift and lower the lifting plate by rotation of the crank portion. FIG. 22 describes a configuration of a sheet feeding apparatus according to the present embodiment. Note that the same reference numerals or characters in FIG. 2 refer to the same or identical components in FIG. 22.

In FIG. 22, a drive shaft crank portion 50*a* is provided on a drive shaft 50. A link member 51 is rotatably supported by the lifting plate 22 around a link member boss 51*a*. A long-hole shaped link member hole 51*b* is provided in the link member 51. When the drive shaft crank portion 50*a* is engaged with the link member hole 51*b*, the link member 51 is made rotatable and parallel movable with rotation of the drive shaft 50. The drive shaft 50, the drive shaft crank portion 50*a*, and the link member 51 form a lifting portion for lifting and lowering the lifting plate 22.

Figure 23A:
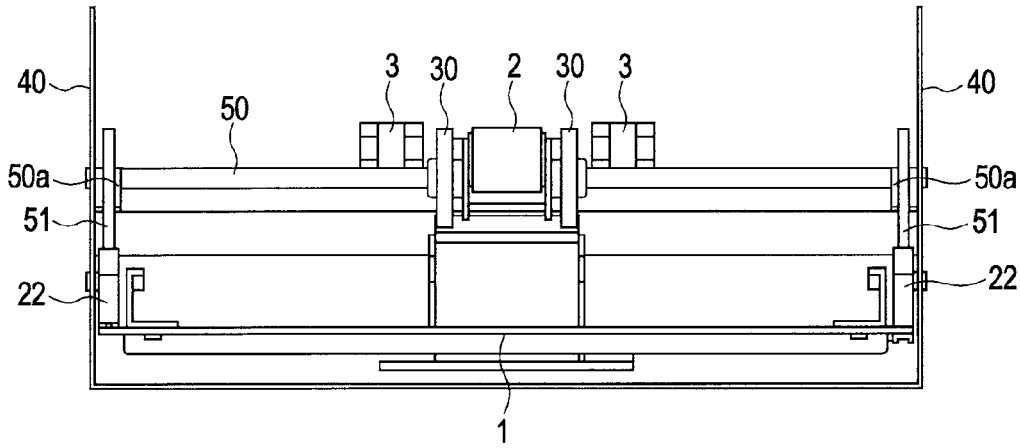
FIG. 23A is a front view describing the configuration of the sheet feeding apparatus.
Figure 23B:
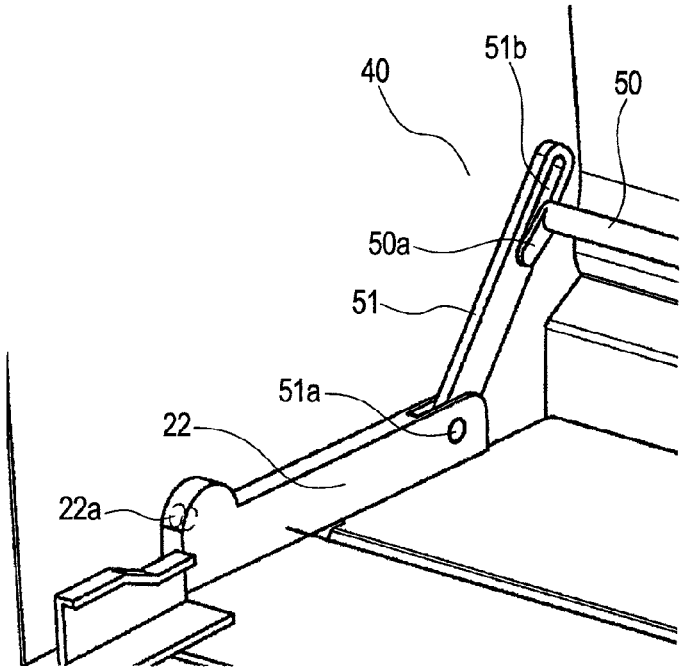
FIG. 23B is a perspective view describing the configuration of the sheet feeding apparatus.

As illustrated in FIGS. 23A and 23B, the drive shaft crank portions 50*a* and the link members 51 are substantially symmetrically arranged around the feed roller 2. The link members 51 are arranged outside the sheet tray 1, and the drive shaft crank portions 50*a* are arranged in positions engaged with the respective link members 51. Thus, each time the drive shaft 50 rotates in a direction indicated by the arrow R1, the lifting plate 22 reciprocates once in a direction indicated by the arrow R2 and in a direction indicated by the arrow R3. In other word, a rotation of the drive shaft 50 determines the position of the lifting plate 22 through the link member 51.

Figure 24A:
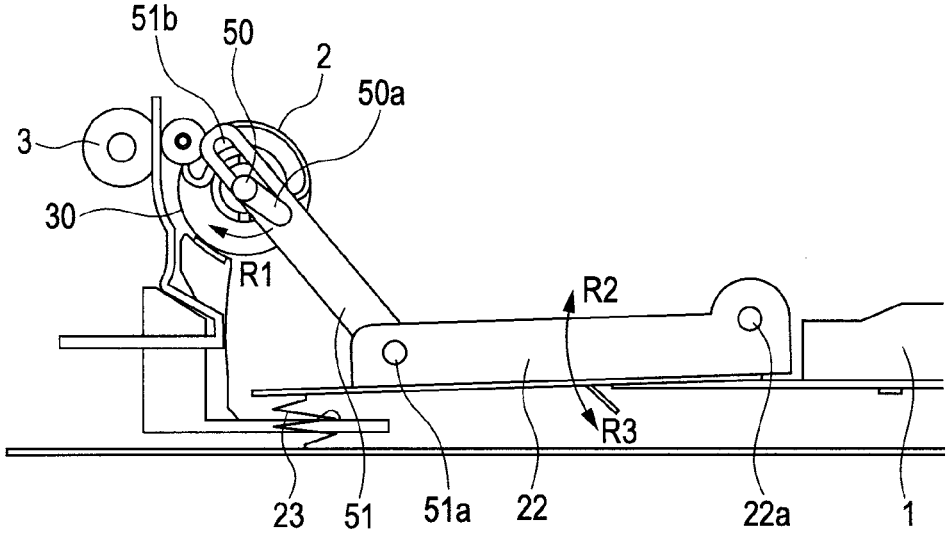
FIGS. 24A and 24B are a first diagram describing a sheet feeding operation of the sheet feeding apparatus.

Next, with reference to FIGS. 24A, 24B, 25A and 25B, the operation of the sheet feeding apparatus according to the present embodiment will be described. FIG. 24A illustrates a state in which the feed roller 2, the link member 51, and the lifting plate 22 are in the initial feed position of the sheet feeding operation. Each time the sheet feeding operation is performed, the feed roller 2, the feed cam 36, the link member 51, and the lifting plate 22 return to the initial feed position.

The sheet feeding operation starts and then a signal is input from an electric board to an unillustrated solenoid. Then, the drive shaft 50 starts rotating and the feed roller 2 fixed to the drive shaft 50 and the drive shaft crank portion 50*a* start rotating in a direction indicated by the arrow R1. Accordingly, the link member 51 engaged with the drive shaft crank portion 50*a* also moves in conjunction therewith.

Figure 24B:
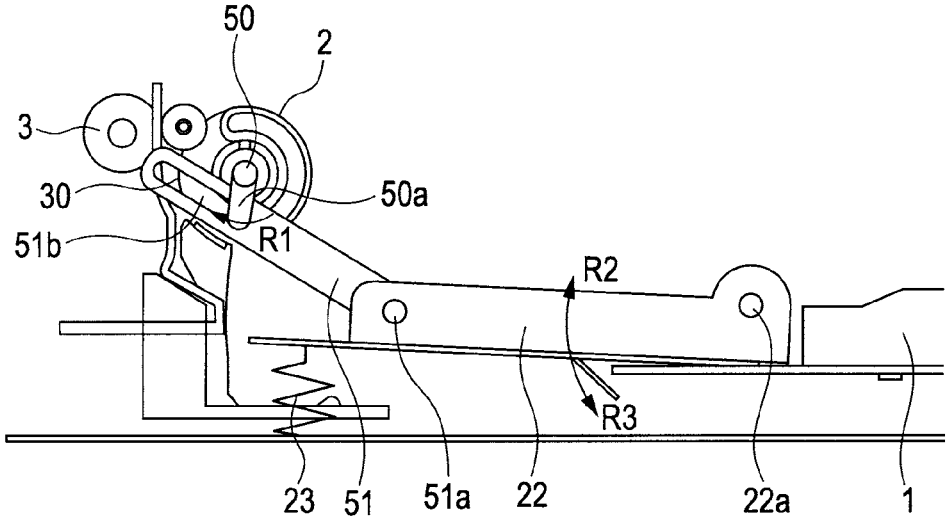

The link member 51 is rotatably supported by the lifting plate 22. Thus, when the link member 51 is made movable in a direction indicated by the arrow R1, as illustrated in FIG. 24B, in response to a biasing force of the feed spring 23, the lifting plate 22 starts rotating in a direction indicated by the arrow R2. Then, when the uppermost sheet of the sheets stacked on the lifting plate abuts against the feed idler roller 30, the lifting plate 22 stops rotating upward and accordingly the link member 51 stops moving. After the lifting plate 22 stops moving, the half-moon shaped feed roller 2 rotating together with the drive shaft 50 abuts against the uppermost sheet and accordingly the uppermost sheet is fed.

Figure 25A:
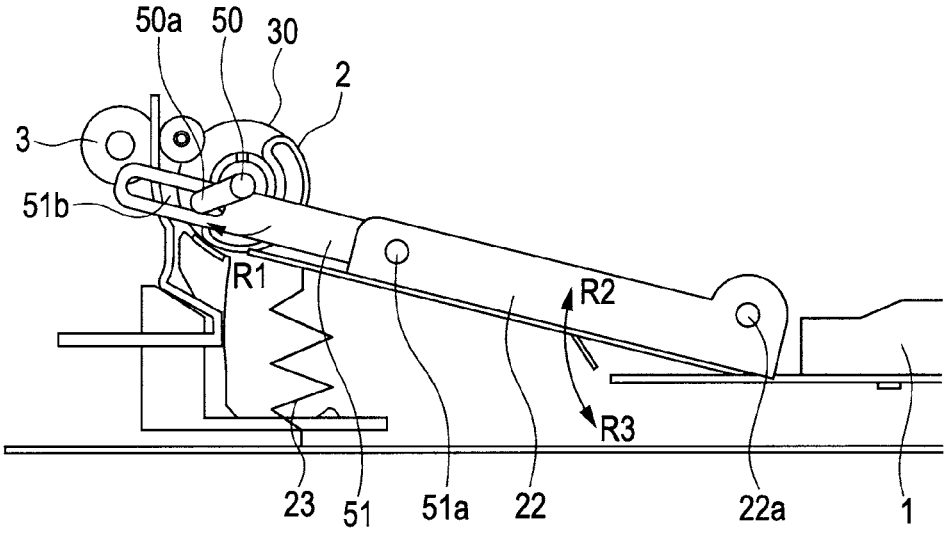
FIGS. 25A and 25B are a second diagram describing the sheet feeding operation of the sheet feeding apparatus.
Figure 25B:
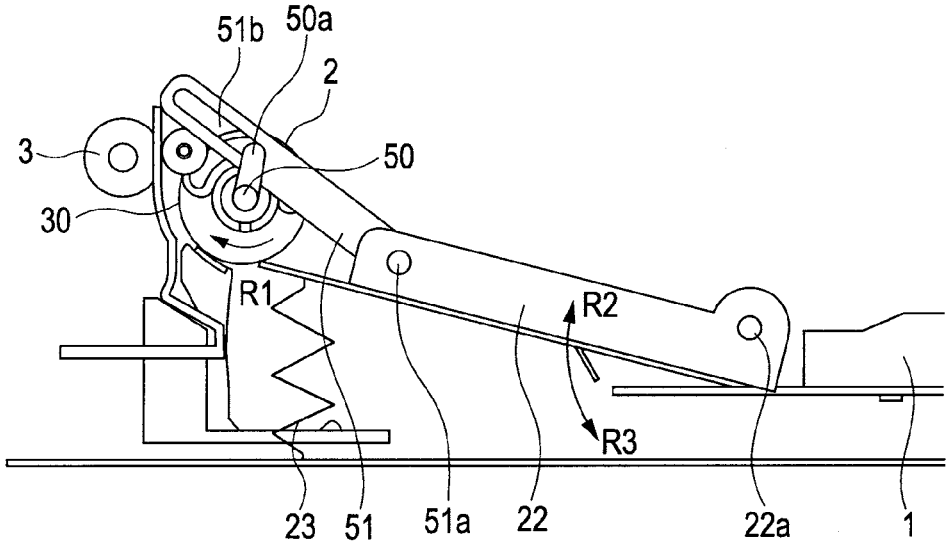

After the sheet feeding starts, the feed roller 2 further rotates. Then, the drive shaft crank portion 50*a* rotates and accordingly the link member 51 starts moving in a direction indicated by the arrow R1 as illustrated in FIG. 25A. When the link member 51 rotates, as illustrated in FIG. 25B, the lifting plate 22 starts rotating in a direction indicated by the arrow R3. At a time when the drive shaft 50 returns to the initial feed position, the rotational driving force is blocked from being transmitted to the drive shaft 50 and the feed roller 2 stops rotating at the initial feed position. When the feed roller 2 reaches the initial feed position, the link member 51 and the lifting plate 22 also return to the initial feed position illustrated in FIG. 24A and then stop moving. Each time this operation is repeated, the sheets stacked on the sheet tray 1 are separated one by one to be fed for each rotation of the feed roller 2.

As described above, the present embodiment can make the link member 51 movable by rotation of the drive shaft crank portion 50*a* to thereby lift and lower the lifting plate 22, thus eliminating the need of the feed cam. As a result, the present embodiment can prevent an increase in the entire size of the sheet feeding apparatus even in a case of using the link member 51. Since the link member 51 is moved by the drive shaft crank portion 50*a*, the present embodiment can eliminate the need of the link guide hole 35 otherwise required to move the link member 51 by the feed cam.

Figure 26:
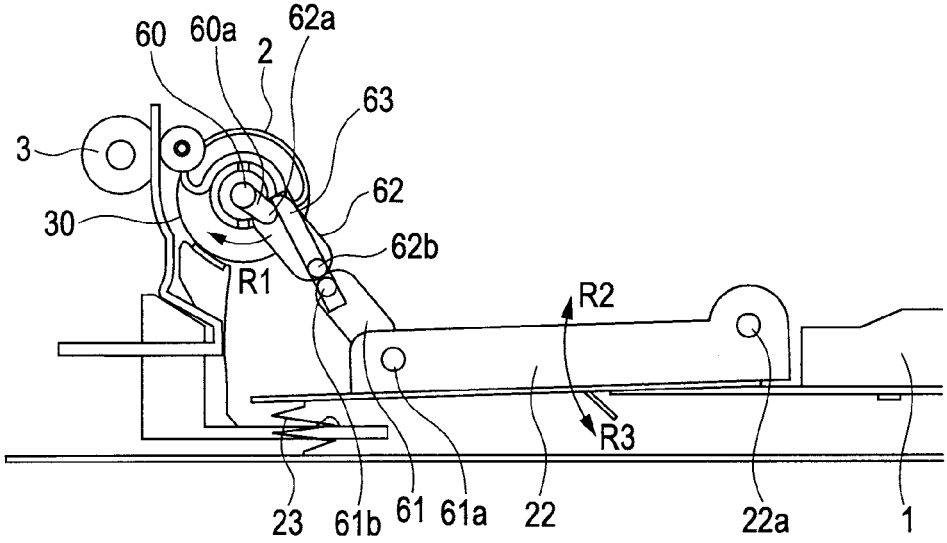
FIG. 26 is a side view describing a configuration of a sheet feeding apparatus according to a sixth embodiment of the present invention.

Next, a sixth embodiment of the present invention will be described. FIG. 26 describes a configuration of a sheet feeding apparatus according to the present embodiment. Note that the same reference numerals or characters in FIG. 2 refer to the same or identical components in FIG. 26.

In FIG. 26, a drive shaft crank portion 60*a* is provided in a drive shaft 60. A first link member 61 is rotatably supported by the lifting plate 22 around a first link member boss 61*a*. A second link member boss 61*b* is provided in a rotation end of the first link member 61. A second link member 62 has a first link member hole 62*a* engaged with the drive shaft crank portion 60*a* and is rotatably supported such that the drive shaft crank portion 60*a* is its fulcrum. A second link member boss 62*b* is provided in a rotation end portion of the second link member 62.

The second link member boss 61*b* of the first link member 61 and the second link member boss 62*b* of the second link member 62 are engaged with a link guide hole 63 provided in a frame. The link guide hole 63 regulates the movement trajectory of the first link member 61 and the second link member 62 through the second link member boss 61*b* of the first link member 61 and the second link member boss 62*b* of the second link member 62. The second link member 62 is in press-contact with the first link member 61 by the feed spring 23 while engaging the second link member boss 62*b* with the link guide hole 63. The drive shaft 60, the first link member 61, the second link member 62, and the link guide hole 63 configure a lifting portion for lifting and lowering the lifting plate 22.

Figure 27A:
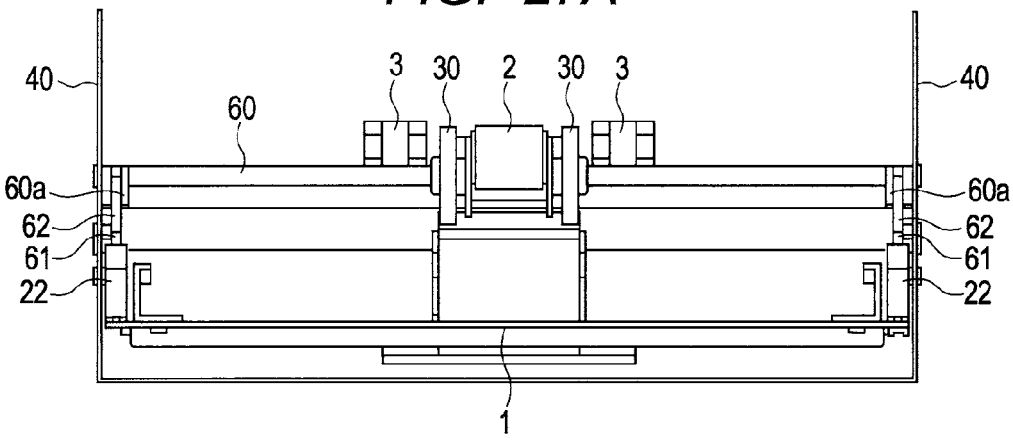
FIG. 27A is a front view describing the configuration of the sheet feeding apparatus.
Figure 27B:
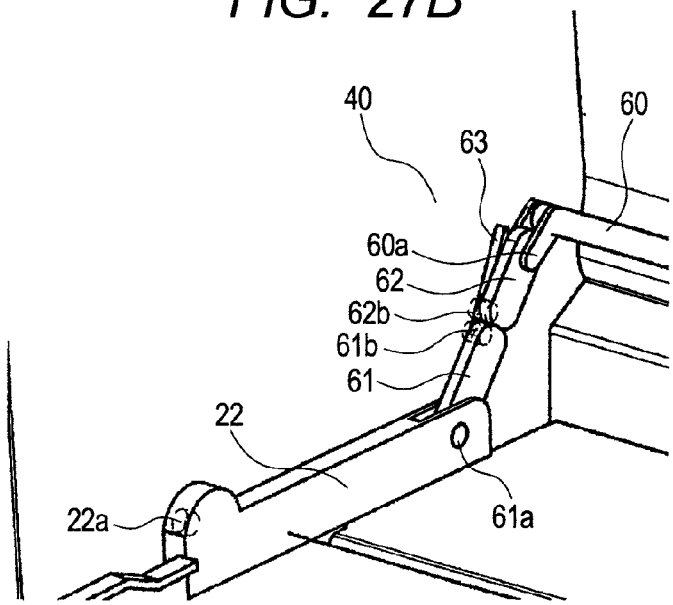
FIG. 27B is a perspective view describing the configuration of the sheet feeding apparatus.

As illustrated in FIGS. 27A and 27B, the drive shaft crank portions 60*a*, the first link members 61, and the second link members 62 are substantially symmetrically arranged around the feed roller 2. The first link members 61 and the second link members 62 are arranged outside the sheet tray 1, and the drive shaft crank portions 60*a* are arranged in positions engaged with the respective second link members 62. Thus, each time the drive shaft 60 rotates in a direction indicated by the arrow R1, the lifting plate 22 reciprocates once in a direction indicated by the arrow R2 and in a direction indicated by the arrow R3. In other word, a rotation of the drive shaft 60 determines the position of the lifting plate 22 through the first link member 61 and the second link member 62.

Figure 28A:
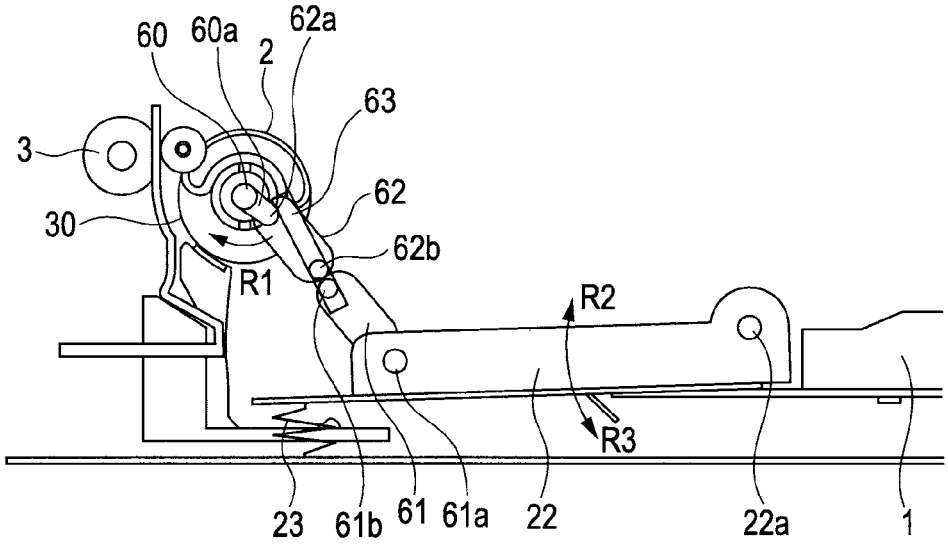
FIGS. 28A and 28B are a first diagram describing a sheet feeding operation of the sheet feeding apparatus.

Next, with reference to FIGS. 28A, 28B, 29A and 29B, the operation of the sheet feeding apparatus according to the present embodiment will be described. FIG. 28A illustrates a state in which the feed roller 2, the drive shaft 60, the first link member 61, the second link member 62, and the lifting plate 22 are in the initial feed position. Each time the sheet feeding operation is performed, the feed roller 2, the drive shaft 60, the first link member 61, the second link member 62, and the lifting plate 22 return to the initial feed position.

The sheet feeding operation starts and then a signal is input from an electric board to an unillustrated solenoid. Then, the drive shaft 60 starts rotating and the feed roller 2 fixed to the drive shaft 60 and the drive shaft crank portion 60*a* start rotating in a direction indicated by the arrow R1. Accordingly, the second link member 62 engaged with the drive shaft crank portion 60*a* moves upward along the link guide hole 63. When the second link member 62 moves upward, the first link member 61 being in press-contact with the second link member 62 is made movable upward integrally therewith.

Figure 28B:
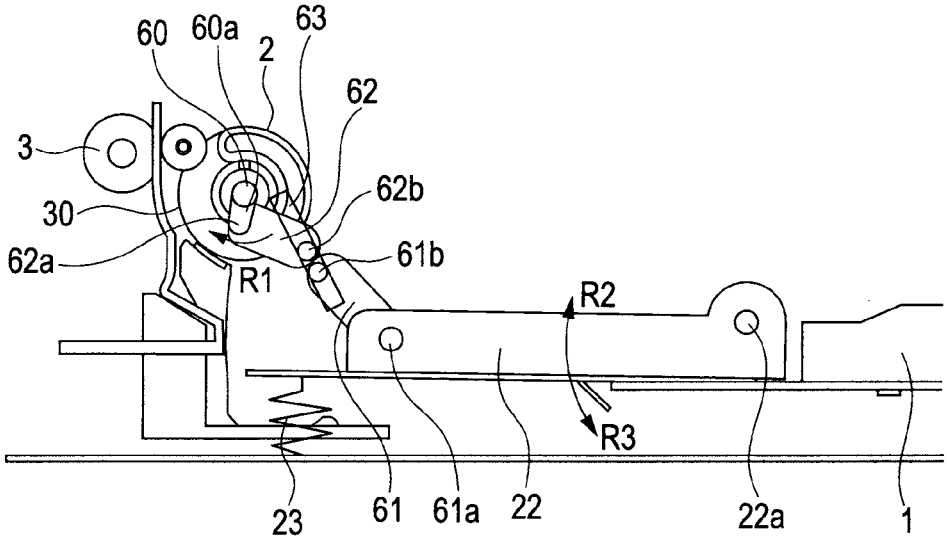

The first link member 61 is rotatably supported by the lifting plate 22. Thus, when the link member 61 is made movable upward, as illustrated in FIG. 28B, in response to a biasing force of the feed spring 23, the lifting plate 22 starts rotating in a direction indicated by the arrow R2. Then, when the uppermost sheet of the sheets stacked on the lifting plate 22 abuts against the feed idler roller 30, the lifting plate 22 stops rotating upward and accordingly the first link member 61 stops moving upward. After the lifting plate 22 stops moving, the half-moon shaped feed roller 2 rotating together with the drive shaft 60 abuts against the uppermost sheet and accordingly the uppermost sheet is fed. Subsequently, the drive shaft 60 continues rotating in a direction indicated by the arrow R1. Thus, the second link member 62 also moves along the link guide hole 63 in conjunction therewith, whereby the first link member 61 and the second link member 62 are spaced apart from each other.

Figure 29A:
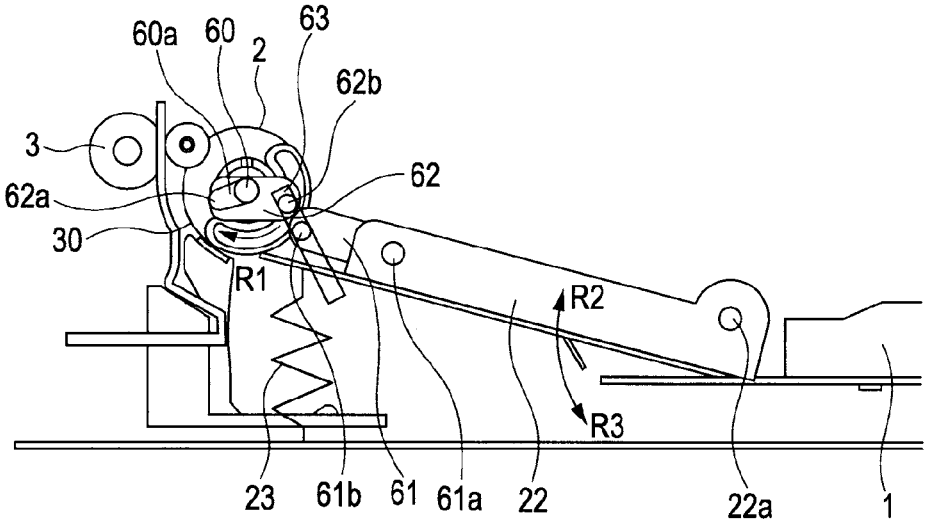
FIGS. 29A and 29B are a second diagram describing the sheet feeding operation of the sheet feeding apparatus.
Figure 29B:
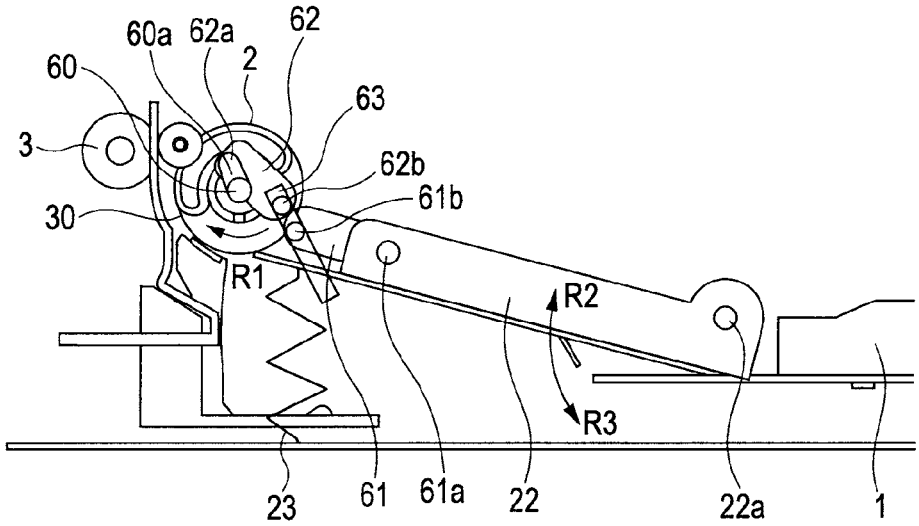

After the sheet feeding starts, the feed roller 2 further rotates. Then, the second link member 62 moves downward along the link guide hole 63 and press-contacts the first link member 61 again. Accordingly, the first link member 61 starts moving downward along the link guide hole 63. When the link member 61 moves downward, as illustrated in FIG. 29B, the lifting plate 22 starts rotating in a direction indicated by the arrow R3. At a time when the drive shaft 60 returns to the initial feed position, the rotational driving force is blocked from being transmitted to the drive shaft 60 and the feed roller 2 stops rotating at the initial feed position.

When the feed roller 2 reaches the initial feed position, the feed roller 2, the drive shaft 60, the first link member 61, the second link member 62, and the lifting plate 22 also return to the initial feed position illustrated in FIG. 28A and then stop moving. Each time this operation is repeated, the sheets stacked on the sheet tray 1 are separated one by one to be fed for each rotation of the feed roller 2.

As described above, the present embodiment can make the first link member 61 and the second link member 62 movable by rotation of the drive shaft crank portion 60*a* to thereby lift and lower the lifting plate 22, thus eliminating the need of the feed cam. As a result, the present embodiment can prevent an increase in the entire size of the sheet feeding apparatus even in a case of using the first link member 61 and the second link member 62.

Figure 30:
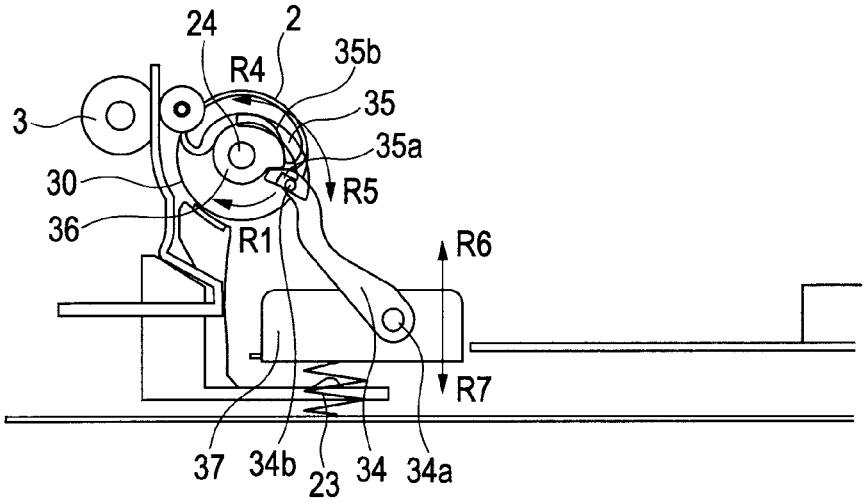
FIG. 30 is a side view describing another configuration of the sheet feeding apparatus according to the first to sixth embodiments of the present invention.

In the above description, for each rotation of the feed roller 2, the lifting plate 22 performs one reciprocating motion of rotation around the lifting plate boss 22*a* in a direction indicated by the arrows R2 and R3. However, as illustrated in FIG. 30, a lifting plate 37 may be provided to perform one reciprocating motion of parallel movement in a direction indicated by the arrows R6 and R7. Since the lifting plate 37 is provided to be movable upward and downward in a horizontal state, the size of the lifting plate 37 can be reduced, whereby a smaller-sized sheet feeding apparatus for the image forming apparatus can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-058348, filed Mar. 16, 2011, and Japanese Patent Application No. 2011-249811, filed Nov. 15, 2011, which are hereby incorporated by reference herein in their entirety.

What is claimed is:

1. A sheet feeding apparatus comprising:

a sheet supporting portion capable of being lifted and lowered while supporting a sheet;

a feed roller located above the sheet supporting portion and feeding the sheet stacked on the sheet supporting portion; and a lifting portion lifting and lowering the sheet supporting portion between an initial feed position and a position at which the feed roller feeds the sheet supported on the sheet supporting portion, and the lifting portion including:

a biasing portion which biases the sheet supporting portion toward the feed roller;

a link member which is rotatably supported by the sheet supporting portion;

a holding portion which holds the link member so as to position the sheet supporting portion against a biasing force of the biasing portion at the initial feed position;

a regulation release portion which rotates integrally with the feed roller and releases the holding of the link member held by the holding portion when the sheet is fed; and a rotation regulating portion which regulates a rotation of the link member in a predetermined range, wherein the rotation regulating portion includes a guide portion to regulate movement of the link member in the predetermined range and the holding portion is provided on the guide portion, and wherein while the regulation release portion is rotated with the feed roller which feeds the sheet supported on the sheet supporting portion, the regulation release portion engages with the link member to move the sheet supporting portion to the feed initial position and the link member is held by the holding portion.

2. The sheet feeding apparatus according to claim 1, wherein the regulation release portion is a cam member rotating integrally with the feed roller, and the rotation regulating portion regulates a rotation of the link member such that the link member slides along a cam surface of the cam member when the cam member rotates.

3. The sheet feeding apparatus according to claim 1, wherein the guide portion guides movement of the link member when the sheet supporting portion moves upward and downward.

4. The sheet feeding apparatus according to claim 2, wherein after the sheet is fed, the cam member moves the link member to a position facing a locking portion so as to lock the link member to the locking portion by the biasing force of the biasing portion.

5. The sheet feeding apparatus according to claim 1, wherein the biasing portion includes a biasing member which always biases the sheet supporting portion toward the feed roller; and an auxiliary biasing portion which generates a biasing force toward the feed roller when the sheet is fed.

6. The sheet feeding apparatus according to claim 5, wherein the regulation release portion is a cam member, the auxiliary biasing portion includes a spring one end of which is locked to the link member and the other end of which is locked to the sheet supporting portion; and a protruding portion formed on a cam surface of the cam member, and when the link member rotates by being pressed by the protruding portion of the cam member, the spring generates a spring force to bias the sheet supporting portion toward the feed roller.

7. A sheet feeding apparatus comprising:

a sheet supporting portion capable of being lifted and lowered while supporting a sheet;

a feed roller located above the sheet supporting portion and feeding the sheet stacked on the sheet supporting portion; and a lifting portion lifting and lowering the sheet supporting portion between an initial feed position and a position at which the feed roller feeds the sheet supported on the sheet supporting portion, and the lifting porting including:

a biasing portion which biases the sheet supporting portion toward the feed roller;

a link member which is rotatably supported by the sheet supporting portion;

a cam member rotating integrally with the feed roller and which releases holding of the link member held by a holding portion when the sheet is fed; and a rotation regulating portion which regulates a rotation of the link member in a predetermined range, wherein the rotation regulating portion is a guide member provided on a shaft of the feed roller and having a long groove engaged with a boss provided on the link member such that the link member slides along a cam surface of the cam member when the cam member rotates.

8. A sheet feeding apparatus comprising:

a sheet supporting portion capable of being lifted and lowered while supporting a sheet;

a feed roller located above the sheet supporting portion and feeding the sheet stacked on the sheet supporting portion; and a lifting portion lifting and lowering the sheet supporting portion between an initial feed position and a position at which the feed roller feeds the sheet supported on the sheet supporting portion, the lifting portion including:

a biasing portion which biases the sheet supporting portion toward the feed roller;

a link member which is rotatably supported by the sheet supporting portion;

a regulation release portion which rotates integrally with the feed roller and releases holding of the link member held by a holding portion when the sheet is fed; and a pair of guide bosses provided in an image forming apparatus body so as to be positioned on respective opposite sides of the link member to regulate rotate on of the link member.

9. A sheet feeding apparatus comprising:

a sheet supporting portion capable of being lifted and lowered while supporting a sheet;

a feed roller located above the sheet supporting portion and feeding the sheet stacked on the sheet supporting portion; and a lifting portion lifting and lowering the sheet supporting portion between an initial feed position and a position at which the feed roller feeds the sheet supported on the sheet supporting portion, and the lifting portion including:

a biasing portion which biases the sheet supporting portion toward the feed roller; and a link member which is rotatably supported by the sheet supporting portion; and a regulation release portion which rotates integrally with the feed roller and which releases holding of the link member held by a holding portion when the sheet is fed, wherein the regulation release portion is a crank portion rotating integrally with the feed roller to move the link member by the rotation of the crank portion.

10. The sheet feeding apparatus according to claim 9, wherein a long hole which engages the crank portion with the link member is formed in the link member and while the crank portion is engaged with the long hole, the link member is moved by the rotation of the crank portion.

11. The sheet feeding apparatus according to claim 9, wherein the link member includes a first link member rotatably supported by the sheet supporting portion; and a second link member rotatably supported by the crank portion and being in a press-contact with the first link member biased by the biasing portion, and the first link member and the second link member are integrally moved by the rotation of the crank portion.

12. The sheet feeding apparatus according to claim 1, wherein the sheet supporting portion is provided to be movable upward and downward in a horizontal state.

13. An image forming apparatus comprising:

a sheet supporting portion capable of being lifted and lowered while supporting a sheet;

a feed roller located above the sheet supporting portion and feeding the sheet stacked on the sheet supporting portion;

an image forming portion which forms an image on the sheet fed by the feed roller; and a lifting portion lifting and lowering the sheet supporting portion between an initial feed position and a position at which the feed roller feeds the sheet supported on the sheet supporting portion, the lifting portion including:

a biasing portion which biases the sheet supporting portion toward the feed roller;

a link member which is rotatably supported by the sheet supporting portion; and a holding portion which holds the link member so as to position the sheet supporting portion against a biasing force of the biasing portion at the initial feed position;

a regulation release portion which rotates integrally with the feed roller and which releases holding of the link member held by the holding portion when the sheet is fed; and a rotation regulating portion which regulates a rotation of the link member in a predetermined range, wherein the rotation regulating portion includes a guide portion to regulate a movement of the link member in the predetermined range and the holding portion is provided on the guide portion, and wherein while the regulation release portion is rotated with the feed roller which feeds the sheet supported on the sheet supporting portion, the regulation release portion engages with the link member to move the sheet supporting portion to the feed initial position and the link member is held by the holding portion.

14. The image forming apparatus according to claim 13, wherein the regulation release portion is a cam member rotating integrally with the feed roller, and the rotation regulating portion regulates a rotation of the link member such that the link member slides along a cam surface of the cam member when the cam member rotates.

15. The image forming apparatus according to claim 13, wherein the guide portion guides movement of the link member when the sheet supporting portion moves upward and downward.

16. The image forming apparatus according to claim 14, wherein after the sheet is fed, the cam member moves the link member to a position facing a locking portion so as to lock the link member to the locking portion by the biasing force of the biasing portion.

17. The image forming apparatus according to claim 13, wherein the biasing portion includes a biasing member which always biases the sheet supporting portion toward the feed roller; and an auxiliary biasing portion which generates a biasing force toward the feed roller when the sheet is fed.

18. The image forming apparatus according to claim 17, wherein the regulation release portion is a cam member, the auxiliary biasing portion includes a spring one end of which is locked to the link member and the other end of which is locked to the sheet supporting portion; and a protruding portion formed on a cam surface of the cam member, and when the link member rotates by being pressed by the protruding portion of the cam member, the spring generates a spring force to bias the sheet supporting portion toward the feed roller.

19. An image forming apparatus comprising:

a sheet supporting portion capable of being lifted and lowered while supporting a sheet;

a feed roller located above the sheet supporting portion and feeding the sheet stacked on the sheet supporting portion;

an image forming portion which forms an image on the sheet fed by the feed roller; and a lifting portion lifting and lowering the sheet supporting portion between an initial feed position and a position at which the feed roller feeds the sheet supported on the sheet supporting portion, the lifting portion including:

a biasing portion which biases the sheet supporting portion toward the feed roller;

a link member which is rotatably supported by the sheet supporting portion;

a cam member rotating integrally with the feed roller and which releases holding of the link member held by a holding portion when the sheet is fed; and a rotation regulating portion which regulates a rotation of the link member in a predetermined range, wherein the rotation regulating portion is a guide member provided on a shaft of the feed roller and having a long groove engaged with a boss provided on the link member such that the link member slides along a cam surface of the cam member when the cam member rotates.

20. An image forming apparatus comprising:

a sheet supporting portion capable of being lifted and lowered while supporting a sheet;

a feed roller located above the sheet supporting portion and feeding the sheet stacked on the sheet supporting portion;

an image forming portion which forms an image on the sheet fed by the feed roller; and a lifting portion lifting and lowering the sheet supporting portion between an initial feed position and a position at which the feed roller feeds the sheet supported on the sheet supporting portion, the lifting portion including:

a biasing portion which biases the sheet supporting portion toward the feed roller;

a link member which is rotatable supported by the sheet supporting portion;

a cam member rotating integrally with the feed roller and releases holding of the link member held by a holding portion when the sheet is fed; and a pair of guide bosses provided in an image forming apparatus body so as to be positioned on respective opposite sides of the link member to regulate rotation of the link member.

21. An image forming apparatus comprising:

a sheet supporting portion capable of being lifted and lowered while supporting a sheet;

a feed roller located above the sheet supporting portion and feeding the sheet stacked on the sheet supporting portion;

an image forming portion which forms an image on the sheet fed by the feed roller; and a lifting portion lifting and lowering the sheet supporting portion between an initial feed position and a position at which the feed roller feeds the sheet supported on the sheet supporting portion, the lifting portion including:

a biasing portion which biases the sheet supporting portion toward the feed roller;

a link member which is rotatably supported by the sheet supporting portion; and a regulation release portion which rotates integrally with the feed roller and which releases holding of the link member held by a holding portion when the sheet is fed, wherein the regulation release portion is a crank portion rotating integrally with the feed roller to move the link member by the rotation of the crank portion.

22. The image forming apparatus according to claim 21, wherein a long hole which engages the crank portion with the link member is formed in the link member and while the crank portion is engaged with the long hole, the link member is moved by the rotation of the crank portion.

23. The image forming apparatus according to claim 21, wherein the link member includes a first link member rotatably supported by the sheet supporting portion; and a second link member rotatably supported by the crank portion and being in a press-contact with the first link member biased by the biasing portion, and the first link member and the second link member are integrally moved by the rotation of the crank portion.

24. The image forming apparatus according to claim 13, wherein the sheet supporting portion is provided to be movable upward and downward in a horizontal state.

* * * * *